US012371968B2

(12) United States Patent
Lacusta

(10) Patent No.: US 12,371,968 B2
(45) Date of Patent: Jul. 29, 2025

(54) TUBING INSERT ISOLATION VALVE FOR USE WITH LEGACY WELLS, AND METHODS OF USE THEREOF

(71) Applicant: Sabre Machining Ltd., Alberta (CA)

(72) Inventor: Gregg Lacusta, Alberta (CA)

(73) Assignee: Sabre Machining Ltd., Alberta (CA)

( * ) Notice: Subject to any disclaimer, the term of this patent is extended or adjusted under 35 U.S.C. 154(b) by 56 days.

(21) Appl. No.: 18/195,823

(22) Filed: May 10, 2023

(65) Prior Publication Data

US 2024/0376798 A1 Nov. 14, 2024

(30) Foreign Application Priority Data

May 4, 2023 (CA) ..... 3198949

(51) Int. Cl.

| | |
|---|---|
| ***E21B 34/14*** | (2006.01) |
| ***E21B 23/02*** | (2006.01) |
| ***E21B 31/18*** | (2006.01) |
| ***E21B 43/12*** | (2006.01) |

(52) U.S. Cl.

CPC ..... *E21B 34/14* (2013.01); *E21B 23/02* (2013.01); *E21B 43/12* (2013.01); *E21B 31/18* (2013.01); *E21B 2200/06* (2020.05)

(58) Field of Classification Search

CPC ..... E21B 34/14; E21B 23/02; E21B 43/12; E21B 31/18; E21B 2200/06

See application file for complete search history.

(56) References Cited

U.S. PATENT DOCUMENTS

| | | | | |
|---|---|---|---|---|
| 2005/0092501 | A1* | 5/2005 | Chavers | E21B 34/12 166/386 |
| 2005/0095156 | A1* | 5/2005 | Wolters | E21B 34/101 417/555.1 |
| 2012/0261137 | A1* | 10/2012 | Martinez | F17D 1/00 166/373 |
| 2012/0292045 | A1* | 11/2012 | Krawiec | E21B 33/12 166/101 |

(Continued)

FOREIGN PATENT DOCUMENTS

| | | | |
|---|---|---|---|
| CA | 2740567 | A1 | 11/2012 |
| CA | 2778731 | A1 | 11/2013 |

(Continued)

*Primary Examiner* — Blake Michener

(74) *Attorney, Agent, or Firm* — Procopio, Cory, Hargreaves & Savitch LLP

(57) ABSTRACT

A tubing isolation valve configured to permit lowering thereof downhole and installation in an existing pump seating nipple at a distal end of a production string. An elongate mandrel having at least 2 ports is slidably positioned in a hollow seal sub. A portion of the resulting assembly is positionable via a landing tool within the pump seating nipple. The mandrel is slidably moveable within the seal sub and pump seating nipple, from a first open position where fluids can be pumped from the wellbore via a pump fluidly connected to the landing tool, to a second closed position where fluids are isolated from the production tubing. Configurations of and methods of installing and operating the isolation valve when for example removing a pump from the well, and for removing the isolation valve completely from pump seating nipple and wellbore if desired, are further disclosed.

20 Claims, 14 Drawing Sheets

(56) References Cited

U.S. PATENT DOCUMENTS

| | | | | |
|---|---|---|---|---|
| 2013/0319694 | A1* | 12/2013 | Lacusta | E21B 34/14<br>166/334.1 |
| 2013/0319695 | A1* | 12/2013 | Krawiec | E21B 43/121<br>166/334.1 |
| 2019/0368311 | A1* | 12/2019 | Krawiec | E21B 43/127 |

FOREIGN PATENT DOCUMENTS

| | | | |
|---|---|---|---|
| CA | 2802211 | A1 | 11/2013 |
| CA | 3006884 | A1 | 1/2019 |

* cited by examiner (open)

(closed)

(open)

(closed)

TUBING INSERT ISOLATION VALVE FOR USE WITH LEGACY WELLS, AND METHODS OF USE THEREOF

FIELD OF THE INVENTION

The present invention relates to isolation valves for use downhole in wellbores, and more specifically to a tubular isolation valve and apparatus for isolating wells from surface when tripping out a downhole pump for replacement or repair, and methods of employing such isolation valve.

BACKGROUND OF THE INVENTION AND DESCRIPTION OF THE PRIOR ART

For safety and environmental reasons it is typically a legally mandated requirement, when a downhole pump is removed from a wellbore used for producing fluids from an underground formation, that fluids from the wellbore (often containing poisonous gases such as $H_2S$ and flammable gases and liquids) not be capable of entering the wellbore and escaping to surface.

Specifically, when piping or continuous tubing having at a distal end thereof a downhole pump for pumping fluids in the wellbore to surface need be "tripped out" of the wellbore for replacement or servicing, it is essential that steps be taken to prevent poisonous and flammable gases and liquids then flowing into the bottom of the wellbore and thereafter freely to surface.

In instances when desiring to replace a downhole pump in a wellbore (which can be a frequent necessity if highly abrasive compounds such as sand is contained in the produced fluids being pumped from the wellbore), prior to tripping out and removing such pump the well to comply with the aforementioned legally mandated requirements would typically need to be "killed" by injection of fluids (known as "kill fluids"). The injected "kill" fluids would inhibit and stop flow of fluids and gases into the wellbore, thereby effectively isolating such gases and fluids in the formation from the wellbore so that the pump could then be removed from the wellbore without causing leaking of gases and liquids (sometimes under considerable pressure) from the formation into the wellbore.

Although the "kill fluids" can be later pumped out of the well with the new/repaired installed pump, such "kill fluids" are typically toxic and/or contain toxic and flammable compounds and their safe disposal was and is an environmental and cost issue.

Moreover, having to firstly "kill" a well before being able to replace a downhole pump is not only expensive in terms of time as well as the cost of purchase of such fluids and the cost of then pumping/injecting them down the well and then recovering them from the wellbore, but importantly the process of "killing" a well often negatively impacts the subsequent performance of the well and the ability to bring the well back into its former production flow rates prior to having been "killed".

Fortunately, isolation valves were developed to avoid the need to inject "kill" fluids in the well before removing a pump for replacement or repair.

Such prior art isolation valves, often situated below the pump seating nipple a were designed, upon pulling of the pump upward when the pump was being tripped out of the well, to sealingly engage the pump seating nipple thereby isolating the formation from surface when the pump itself was withdrawn from the well.

Typically, however, in older versions of such prior art isolation valves, effective sealing was not always consistent as it required precise vertical positioning from surface of the isolation valve within the pump seating nipple within a wellbore. The seating nipple was typically many thousands of feet below surface and getting accurate location of the isolation valve within a pump seating nipple to effect isolation of the well when changing out a pump was frequently problematic. There was no fixed automatic location of the isolation valve in the pump seating nipple to consistently situate the isolation valve in the pump seating nipple for effective sealing.

Later versions of prior art isolation valves and pump seating nipples possessed improvements. Such improved or modified isolation valve apparatus typically however employed specially-designed isolation valve apparatus utilizing a plurality of (or substantially modified) seal housings and an isolation valve, and were only capable of being used on new production strings after an old pump and production string, including a pump seating nipple, had first been pulled from the well. A new production string, or at least a production string having a modified seal housing, an isolation valve, and a new pump would then all be run downhole in the wellbore with a new or repaired pump. These modified seal housings and isolation valves, when actuated, would then thereafter effectively isolate the well for the duration of the period when if and when the pump then later needed to again be tripped out. When a new pump was thereafter run into the well, the isolation valve could then be caused to open, allowing the replacement pump to thereafter resume production from the well.

Disadvantageously however with respect to utilizing such further improved isolation valves and systems for an existing well, such required tripping out of an existing pump seating nipple from a so-called "legacy" well and replacement of such single seating nipple with typically a seating nipple and modified seal housing and modified isolation valve. These "new" prior art isolation valves were only designed for use with attendant modified pump seating nipples specifically positioned on a modified production string and/or modified seal housings.

There was thus no ability, as regards such newly designed isolation valves and systems, to utilize such new isolation valves in so-called "legacy" wells, and as noted the existing production string and seating nipple would need to be first completely tripped out of the well before an improved isolation valve and typically a re-designed seal housing and/or specifically-positioned seating subs in the production string, could then be run into the well. CA 2,740,567 published Nov. 17, 2012 entitled "*Downhole Pump Apparatus Having Decoupleable Isolation Plug*" (having one inventor in common to the invention later described herein) was an early iteration of an isolation valve system for isolating a well during removal of a pump, which required modified production piping. FIGS. 2A-2D and FIGS. 4A-4D of CA '567 teach two respective embodiments of the isolation valve and system. The embodiment in FIGS. 2A-2D shows a configuration utilising an isolation plug (40) releasibly coupled to a latch member (50) disposed at a distal end of a pump (6), which itself is disposed below a holding member 16 having a seating surface 18 thereon. Two seating nipples 20*a*, 20*b* spaced along the production string, one of which is above the pump, permit respective sealing of the holding member 16 and the isolation plug (40) therein during removal of the pump. The embodiment shown in FIGS. 4A-4D shows a similar embodiment, but where both the holding member 16 and seals 18 thereon and the isolation valve (40) are both disposed below the pump 6, and again holding member 16 and isolation valve (40) respectively engage two seating nipples, namely 20*a* and 20*b* during tripping out of the pump.

CA 2,778,731 published Nov. 30, 2013 entitled "*Downhole Ported Shifting Sleeve*" (again having one inventor common to the invention later described herein), in FIGS. 2A-2D, and FIGS. 4A-4D thereof, describes a prior art downhole tubing system utilizing a circumferential seal 20 and ported seal sub 24 which then serves as the isolation plug, with a holding member 18 adapted to sealing engage about its outer periphery circumferential seal 20, and a ported sleeve 80 adapted to slidingly engage seal sub 24, which functions as the valve.

CA 2,802,211 published Nov. 30, 2013 entitled "*Improved Downhole Isolation Tool having a Ported Sliding Sleeve*" (again having one inventor common to the invention later described herein), generally describes the prior art ALII™ (Artificial Lift Intake Isolation) isolation valve system manufactured and sold by Oil Rebel Manufacturing Ltd. As may be seen, for example, from FIG. 7A, 7B and FIGS. 9-11 of CA 2,892,211, such isolation valve system utilizes a specially-configured side-ported seal sub 230 within a production string 30, within which and slidably moveable therein is an elongate sliding sleeve 202 which together with seal sub 230 forms the isolation valve 200. For effective operation of pump 6 to be able to draw fluids into it via ports 222, pump seating nipple 20 is provided above seal sub 230, in which sits in a holding member 16 with associated seal 18 to seal and thereby allow the pump to draw fluids up from below holding member 16 and into pump 6 via ports 222. A YouTube™ video of such ALII™ isolation valve system and its manner of construction and implementation was first made available/published Sep. 8, 2016 may be found at https://youtu.be/p4SUddVi6js.

Importantly, in the ALII system the seal sub 230 cannot be passed through or into the pump seating nipple 20 from uphole, and instead the production string with seal sub 230 situated below pump seating nipple 20 must firstly be assembled uphole, and any existing pump seating nipple in the existing production string firstly withdrawn from the hole. Accordingly the ALII™ isolation tool and system is unusable for use "legacy" wells, as there is no ability to pass the seal sub 230 through the existing pump seating nipple so as to be able to seat then seat the pump in an existing pump seating nipple.

CA 3,006,884 published Jan. 11, 2019 entitled "*Modified Downhole Isolation Tool Having Seating Means and Ported Sliding Sleeve*" (again having one inventor common to the invention later described herein), likewise utilizes a specially-configured side-ported seal sob 230 within a production string 30, within which and slidably moveable therein is an elongate sliding sleeve 202 which together with seal sub 230 forms the isolation valve 200. Again, the isolation tool and system of CA 3,006,884 is unusable for use "legacy" wells, as there is no ability to pass the seal sub 230 through the existing pump seating nipple so as to be able to seat then seat the pump in the existing pump seating nipple.

Accordingly, a real need exists in the upstream petroleum industry for an isolation valve and system which can be used in "legacy" wells and which is adapted for use with existing pump seating nipple designs, and which avoids having to first trip out existing production piping/tubing

SUMMARY OF THE INVENTION AND SOME OF ITS EMBODIMENTS

Reference herein to the "downhole" side or end of a component shall be understood as referencing the orientation of such component when vertically situated in a wellbore, and specifically the end of such component when in such orientation which is closest the most distal end of the wellbore.

Reference herein to a direction "downhole" shall mean the direction of the region which is, in relation to a component, closest the distal end of a wellbore.

Reference herein to the "uphole" side or end of a component shall be understood as referencing the orientation of such component when situated in a wellbore extending from the surface of the ground into a formation below ground, and specifically the side or end of such component when in such orientation which is closest the surface.

Reference herein to "uphole" of a component or a direction "uphole" shall mean the direction of the region which is, in relation to a component, closest the surface, and in relation to a direction, the direction which is towards the surface.

In order to overcome problems discussed above with prior art isolation valve designs and systems, the invention herein in one of its broad embodiments relates to a tubular insert isolation valve adapted for insertion in a wellbore and configured for insertion in an existing pump seating nipple situated at a distal end of a production string located within a wellbore.

In such first broad aspect, the tubing insert isolation valve of the present invention comprises:

(A) an elongate cylindrical sliding mandrel, having an uphole end and a downhole end, and having a plurality of at least two spaced-apart ports in an outer periphery thereof, said sliding mandrel (260) further having:
  (i) a latch member at an uphole end thereof, configured to allow for releasibly coupling of the sliding mandrel to a landing/conveying tool;
  (ii) a first port of said at least two spaced-apart ports situated proximate the uphole end of the sliding mandrel, downhole of said latch member;
  (iii) a second port of said at least two spaced-apart ports spaced downhole from the first port on the sliding mandrel; and
  (iv) a stop means, situated on an outer periphery of the siding mandrel at said downhole end thereof, and (B) an elongate hollow seal sub, a most-downhole portion of which is adapted to be sealingly and slidably inserted, from a position uphole, thereafter into and through a bore of an existing downhole pump seating nipple situated at a distal end of production tubing in a wellbore, the seal sub having a bore therethrough for slidably receiving therewithin the sliding mandrel and allowing slidable movement of the sliding mandrel from a first downhole open position within the pump seating nipple where a portion of the seal sub and the sliding mandrel extends further downhole and past the pump seating nipple, to a second further-uphole closed position;

the seal sub when said sliding mandrel is slidably positioned in said bore of said seal sub forming annular fluid passageways in interstitial regions between an outer periphery of the sliding mandrel and an inner periphery of the seal sub;

the seal sub further comprising:
  (i) a releasable grasping means, having outwardly-protruding projections thereon (which in one embodiment may comprise a collet, with the outwardly-protruding projections being the collet fingers of the collet);

(ii) an annular no-go portion on a cylindrical periphery of the seal sub, allowing a downhole portion of the seal sub including the releasable grasping means to be inserted into and through the pump seating nipple to a position within the pump seating nipple where the outwardly-protruding projections just extend past a downhole end of the pump seating nipple;

(iii) two seal means, namely:

(I) a first seal means located on an outer periphery of said hollow seal sub and adapted to create a seal between a portion of the seal sub and an inner periphery of the pump seating nipple when the seal sub is inserted in the pump seating nipple; and (II) a second seal means, located in the bore of the hollow seal sub on an inner periphery thereof, adapted to create a seal in the annular passageway between an outer periphery of the sliding mandrel and the inner periphery of the seal sub;

wherein:

(i) when the seal sub together with the sliding mandrel is thereafter inserted from uphole in said pump seating nipple further downhole movement of the seal sub in the pump seating nipple is prevented by the annular no-go portion on the seal sub and the releasable grasping means (in a preferred embodiment comprising a collet having collet fingers) then contacts the pump seating nipple at a most downhole end thereof and thereby resists removal uphole of the seal sub from within the pump seating nipple, the sliding mandrel relative to the seal sub is in the open position whereby fluid flow in said annular passageways is thereby permitted; and (ii) when the sliding mandrel is pulled upward by upward force applied to the latch member the seal sub remains fixed in the pump seating nipple due to the releasable grasping means acting on a lower extremity of the pump seating nipple and resisting removal of the seal sub from the pump seating nipple, and further upward movement of sliding mandrel in the seal sub is arrested by arresting means and the sliding mandrel is then in the closed position within the seal sub and the second seal means then prevents fluid flow through at least one the annular passageways and thus prevents flow of fluid uphole through the pump seating nipple.

In one embodiment, the arresting means comprises stop means situated on an outer periphery of the sliding mandrel proximate the downhole end thereof. The stop means arrests further upward movement of the sliding mandrel when it contacts a stop surface on the seal sub.

In an alternative embodiment, the arresting means comprises shear means situated on an outer periphery of said siding mandrel proximate said downhole end thereof but uphole of the stop means, and the further upward movement of the sliding mandrel is arrested by said shear means contacting a stop surface on the seal sub.

In a refinement, the releasable grasping means comprises a collet member, and said outwardly-protruding projections comprise outwardly-protruding collet fingers of the collet adapted to grasp a lower end of the pump seating nipple.

The second seal means when the sliding mandrel is moved to the closed position prevents flow of fluid into said annular passageways and thus uphole in said isolation valve.

In one refinement the seal sub at a lower extremity thereof possesses an aperture therein, which when the sliding mandrel is in the open position, allows flow of fluid into said first port and thus into the bore of said the sliding mandrel.

In an alternative or additional refinement of the isolation valve, the sliding valve may further comprise a third port in the sliding mandrel, spaced uphole from the second spaced-apart port on the sliding mandrel. In an further modification, the sliding ported mandrel is configured such that when slidably positioned in the closed (second) position the second seal means thereof prevents fluid flow not only in the formed annular passageway within the isolation valve, but also prevents fluid flow into or across said second spaced-apart port and thus into a bore of the sliding mandrel and thereafter uphole.

In a further or alternative refinement, the siding mandrel is provided with a no-go member proximate an uphole end thereof, which serves to prevent excess insertion of the sliding mandrel within the pump seating nipple.

In another alternative or additional refinement, the sliding mandrel may further be provided with a plug member in a portion of the bore thereof between the second spaced-apart port and the first spaced-apart port in the sliding mandrel, and when the sliding mandrel is slidably moved within the seal sub to the closed position, the second seal means and the plug means together prevent fluid flow in one of said annolar passageways between the sliding mandrel and the seal sub.

In a still-further alternative or additional refinement, the sliding mandrel, on a outer periphery thereof has a plurality of protruding collet fingers which together nestably engage an inner circular annulus on said inner periphery of said seal sub when said sliding mandrel is moved to said second closed position in said seal sub, to thereby resist relative downhole sliding movement between said seal sub and said sliding mandrel and thereby resist inadvertent sliding movement due to gravity or otherwise of said sliding mandrel from said second closed position to said first open position once the sliding mandrel is moved to the closed position.

In a still-further alternative refinement, the tubular isolation valve and in particular the shear means thereon is configured such that if a greater force than what was necessary to pull the sliding mandrel to said second position is applied to the latch member, the shear means will shear with its engagement with the sliding mandrel and the sliding mandrel thereby then be permitted to move uphole such that the stop means thereon is likewise moved uphole and thereby away from the protruding collet fingers on the seal sub, thus then permitting said collet fingers to move inward and thereby out of engagement with the pump seating nipple, thereby allowing the entirety of the tubular isolation valve, including the sliding mandrel and the seal sub, to thereafter then be pulled uphole and to surface and out of the wellbore.

In a further aspect of the present invention, an apparatus (ie. isolation valve system) may be provided, wherein such system/apparatus comprises the above-described tubular isolation valve in combination with a decoupleable elongate landing/conveying tool, such decoupleable landing tool having an uphole end and a downhole end and wherein the downhole end is insertable into the bore of said seal sub. The decoupleable landing tool further may possess:

(i) at its downhole end, coupling means to permit releasably coupling of the landing tool to the latch member on the slidable mandrel; and (ii) a port situated in the landing tool at a location thereon uphole of the coupling means, to allow fluid flowing from the annular passageways of said tubular isolation valve to flow into a bore of the decoupleable landing tool.

In a refinement, the decoupleable landing tool, at an uphole end thereof, is releasably coupleable, typically by threadable coupling, to a pump.

In a further alternative or additional refinement of the tubular isolation valve apparatus of the present invention, when the pump is coupled to the uphole end of the landing tool the pump is in fluid communication with the bore of the decoupleable landing tool, and when the decoupleable landing tool is releasibly coupled to the latch member and the seal sub and sliding mandrel are positioned in said first open position in the pump seating nipple, the pump is adapted to pump fluid from flowing from the interior of the sliding mandrel into the decoupleable landing tool and thereafter uphole.

In another broad aspect of the present invention, the invention comprises a method of utilizing a tubular isolation valve in an existing bore of a pump seating nipple.

Specifically, in a first broad aspect of such method, such method comprises utilizing a tubular isolation valve in an existing bore of a pump seating nipple situated at a distal end of a production string located within a wellbore, for permitting pumping of fluid from the wellbore but nevertheless maintaining the ability to thereafter if desired withdraw the pump from the wellbore without losing wellbore containment, or if further desired, fully withdraw the entire tubular isolation valve including the pump from the wellbore.

Such method, in one of its broad aspects, comprises the steps of:

(i) slidably positioning an elongate cylindrical ported mandrel having at least two spaced-apart ports therein within and through a bore of a hollow seal sub until further downhole sliding movement of said ported mandrel within and relative to said seal sub is prevented by a no-go member and the ported mandrel in the seal sub is in a position where fluid may flow through all at least two spaced-apart ports;

(ii) coupling a pump to an uphole end of a landing tool and causing said pump to be in fluid communication with a hollow bore portion of the landing tool;

(iii) releasibly coupling the landing tool, at a downhole end thereof, to a latch member at an uphole end of the ported mandrel;

(iv) frictionally engaging the landing tool with, or alternatively releasibly coupling the landing tool to, an interior periphery of the seal sub at an uphole end of the seal sub, to releasibly maintain the ported mandrel within the seal sub;

(v) lowering the seal sub and ported mandrel downhole in the wellbore using said landing tool to a position wherein a portion of the seal sub and ported mandrel pass into and through the bore of the pump seating nipple;

(vi) arresting complete passage of both the ported mandrel and seal sub through said pump seating nipple by lowering the seal sub and ported mandrel using said landing tool to a position whereby an annular no-go portion, such as an annular ring, on an exterior periphery of said seal sub, contacts the pump seating nipple thereby arresting further downhole movement of said seal sub and ported mandrel through said pump seating nipple; and (vii) causing collet fingers on said seal sub to engage said pump seating nipple so as to thereafter resist uphole movement of said seal sub from within the pump seating nipple.

In a further refinement of the above method, such method comprises the further subsequent steps of:

(i) when desiring to remove the pump from within the wellbore or simply to operate the valve to close it, pulling uphole on the landing tool and causing the ported sliding mandrel to slide within the seal sub to a position within the seal sub where further uphole motion of said ported mandrel is arrested by a shear means (such as an annular ring shearably affixed to an outer periphery of the sliding mandrel), and when the sliding mandrel is in said position fluid is prevented from passing through the seal sub and/or the ported mandrel;

(ii) continuing to pull upward on the landing tool so as to cause releasible decoupling of the landing tool with said latch member on the ported mandrel; and (iii) withdrawing the landing tool and pump thereon from within said wellbore.

In a further refinement, such method comprised the further subsequent steps, when then desiring to recommence pumping of fluid from the wellbore, of subsequently:

(i) lowering the landing tool coupled to a pump at the uphole end of thereof downhole in the wellbore;

(ii) coupling the landing tool at a downhole end thereof to the latch member on the ported mandrel;

(iii) continuing to lower the landing tool in the wellbore so as to cause the landing tool to slidably move the ported mandrel downhole within and relative to the seal sub to a position where further downhole sliding movement of the ported mandrel within and relative to said seal sub is prevented by an annular no-go ring on the seal sub contacting the pump seating nipple, and when in said position the ported mandrel in the seal sub is in an open position where fluid may flow through all at least two spaced-apart ports therein; and (iv) thereafter operating the pump to pump fluids through the seal sub, and ported mandrel to surface.

If it is desired to remove the entirety of the tubular isolation valve from within the wellbore, in an alternative or additional refinement of the aforementioned broad method of the invention such method may further comprise the further subsequent steps of:

(i) lowering a retrieving tool to grasp the latch member of the ported mandrel;

(ii) pulling upward on the latch member and ported mandrel so as to cause the annular shear ring to shear and the ported mandrel to further move uphole relative to the seal sub, until a stop ring on the ported mandrel contacts the seal sub; and (iii) continuing to pull upwardly on the ported mandrel and seal sub so as to cause collet fingers on the seal sub to become disengaged with the pump seating nipple; and (iv) pulling the portions of the seal sub and ported mandrel from within the pump seating nipple uphole and from within the wellbore.

BRIEF DESCRIPTION OF THE DRAWINGS

Further advantages and permutations and combinations of the invention will now appear from the above and from the following detailed description of various particular embodiments of the invention, taken together with the accompanying drawings each of which are intended to be non-limiting, in which:

FIG. 8C is a side elevation cross-sectional view of each of:

Figure 3A:
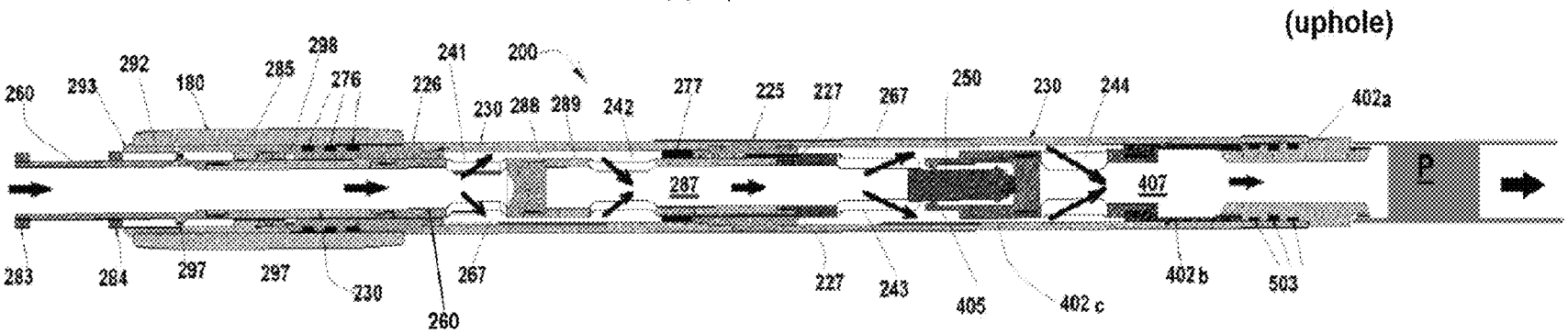
FIG. 3A is a side elevation cross-sectional view of another alternative embodiment of the tubular isolation valve apparatus of the present invention, shown located within a legacy pump seating nipple, where such tubular isolation valve has been conveyed and landed in such location by a landing tool to which a production pump is attached, and where such tubular isolation valve is shown in the open position.
Figure 9:
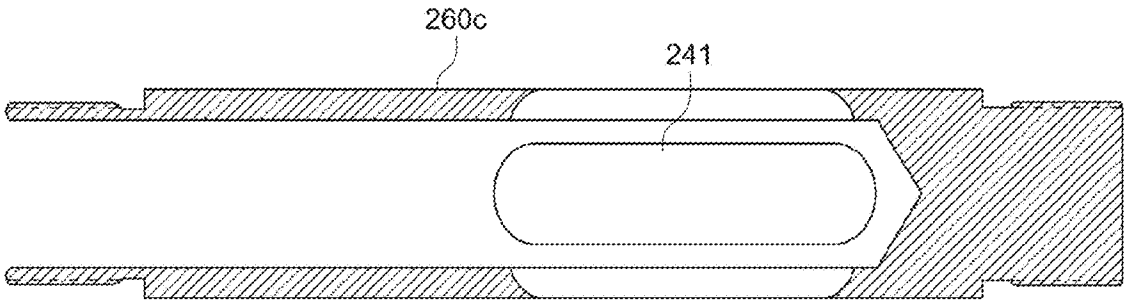
Figure 10:
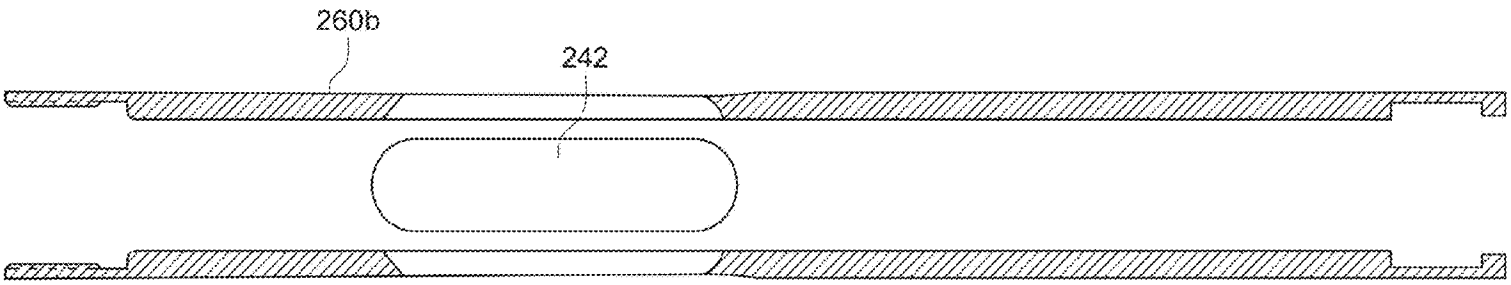
Figure 11:
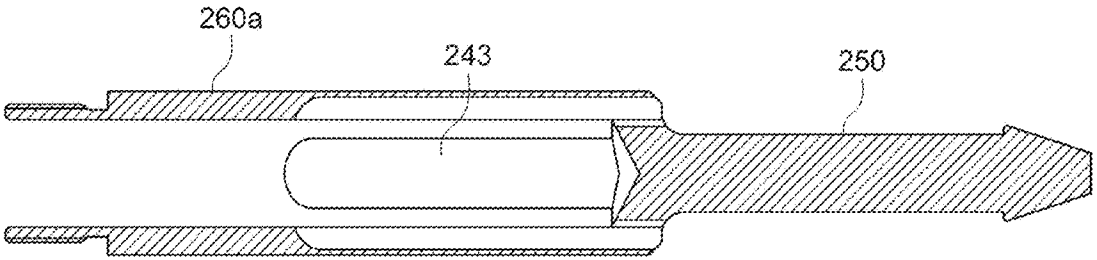
Figure 12A:
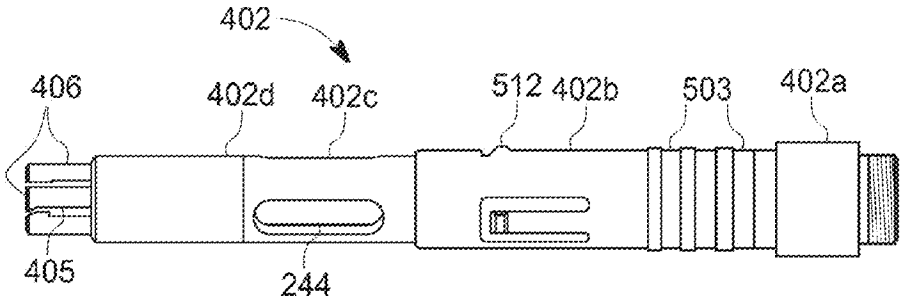
Figure 12B:
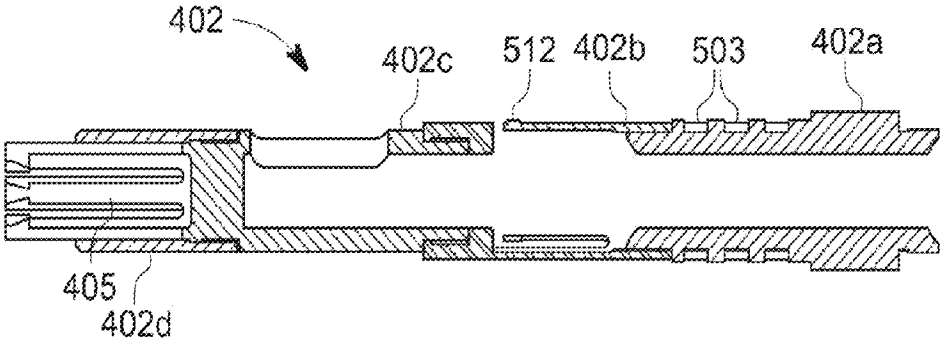
Figure 13:
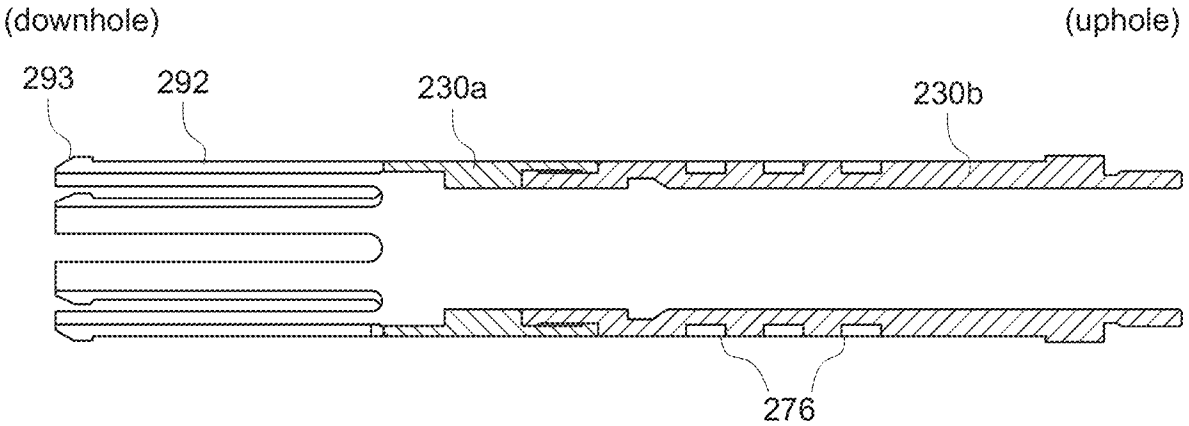
Figure 14:
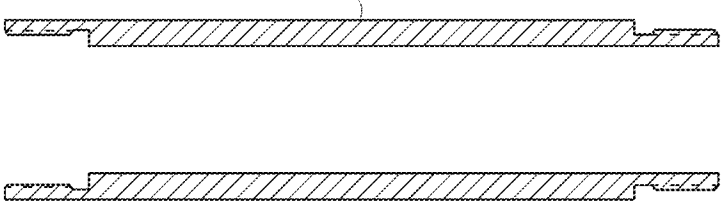

(i) a legacy well having a single legacy pump seating nipple, (ii) the isolation valve of the embodiment shown in FIG. 3A/3B, and (iii) the landing tool used to position the isolation valve in the seating nipple, and further position the sliding mandrel of the isolation valve in either the open position or closed position;

FIG. 9 is a side elevation cross-sectional view of the lower ported mandrel component forming a part of the sliding mandrel of the tubular isolation valve in the embodiment thereof shown in FIGS. 3A/3B;

FIG. 10 is a side elevation cross-sectional view of the upper ported mandrel component forming a part of the sliding mandrel of the tubular isolation valve in the embodiment thereof shown in FIGS. 3A/3B;

FIG. 11 is a side elevation cross-sectional view of the ported pull sub and latch member component forming a part of the sliding mandrel of the tubular isolation valve in the embodiment thereof shown in FIGS. 3A/3B;

FIG. 12A is a side elevation view of the ported landing tool utilized for landing and actuating the isolation valve in either embodiment shown in FIG. 2 or FIG. 3, further having coupled thereto a pump hold-down mandrel which is further adapted at an uphole end thereof to be coupled in fluid communication with a pump;

FIG. 12B is a side elevation cross-sectional view of the ported landing tool shown in FIG. 12A;

FIG. 13 is a side elevation cross-sectional view of the lower collet component forming a part of the sliding mandrel of the tubular isolation valve in the embodiment thereof shown in FIGS. 3A/3B; and FIG. 14 is an enlarged side elevation cross-sectional view of the adapter mandrel component forming a part of the sliding mandrel of the tubular isolation valve in the embodiment thereof shown in FIGS. 3A/3B;

DETAILED DESCRIPTION OF SOME PREFERRED EMBODIMENTS

Figure 1A:
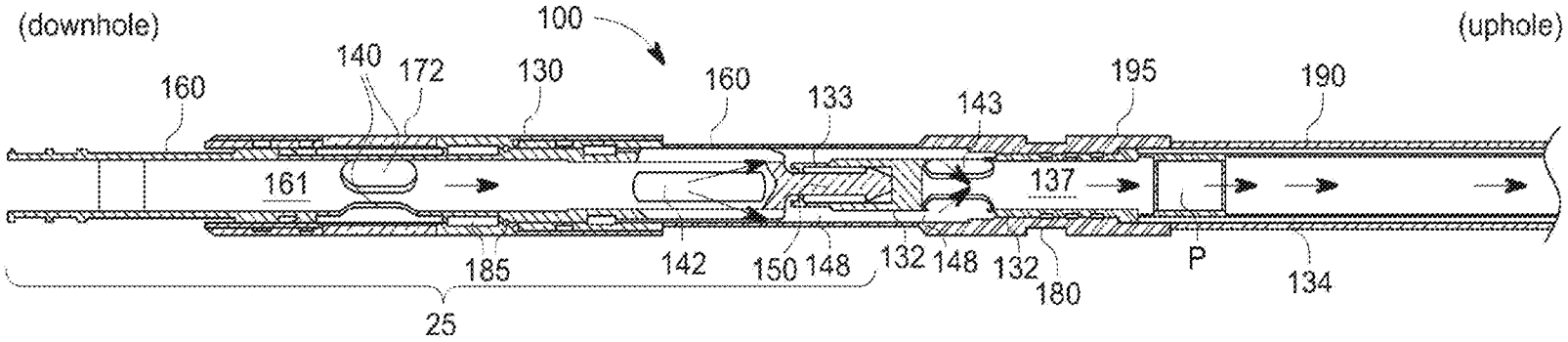
FIG. 1A (Prior Art)
FIG. 1A is a side elevation cross-sectional view of the prior art ALII™ (Artificial Lift Intake Isolation) isolation valve system which has been publicly sold by Oil Rebel Innovations Ltd. of Lloydminster, Alberta, shown in the open position [ALII™ is a trademark of Oil Rebel Innovations Ltd. of Lloydminster, Alberta for a prior art downhole tubing isolation valve]
Figure 1B:
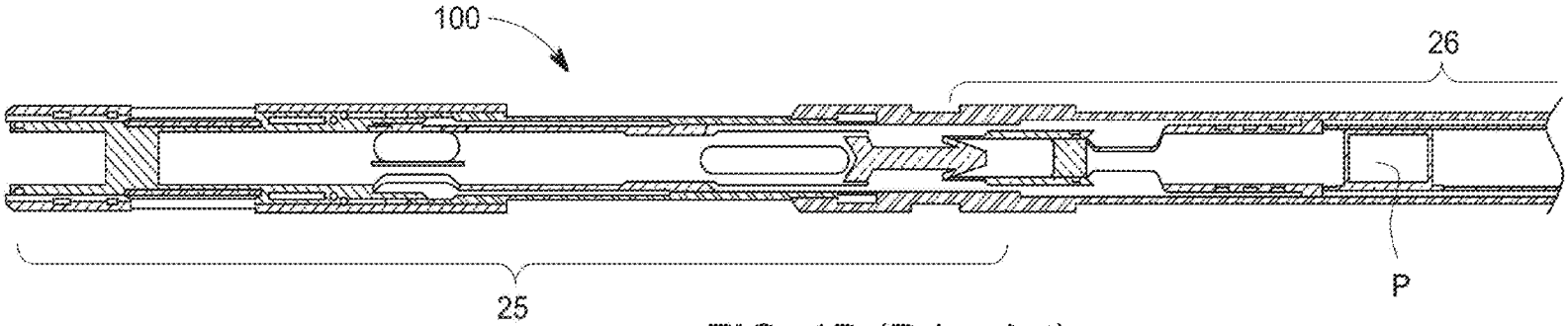
FIG. 1B (Prior Art)
FIG. 1B is a similar a side elevation cross-sectional view of the prior art ALII isolation valve system, shown in the closed position.
Figure 1C:
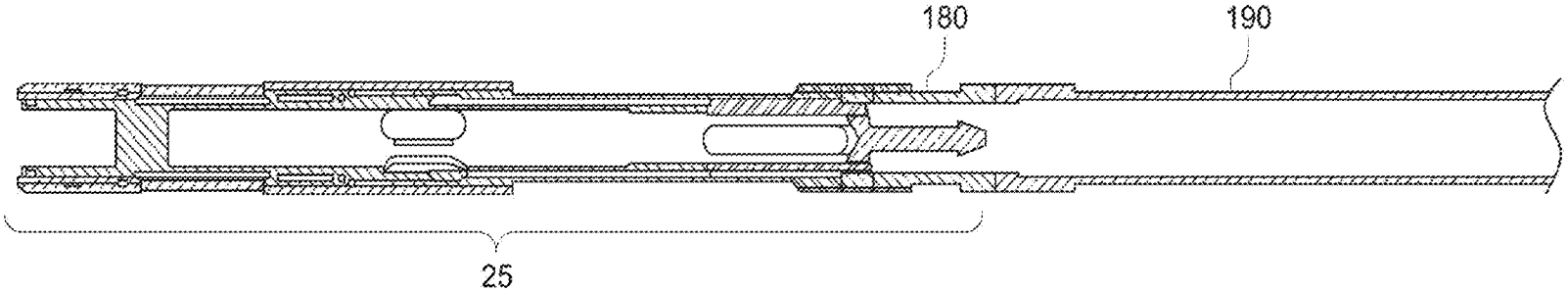
FIG. 1C (Prior Art)
FIG. 1C is a similar side elevation cross-sectional view of the prior art ALII isolation valve system, shown in the decoupled position with the pump decoupled and removed.

FIGS. 1A, 1B& 1C (Prior Art) show a cross-sectional side elevation view of a tubular isolation valve apparatus 100 of the prior art, namely the ALII™ isolation valve, for use in a wellbore.

FIGS. 1A, 1B& 1C show the ALII™ isolation valve when situated in a wellbore in respectively in a valve-open position [FIG. 1A-schematically also showing the flow of fluids (see arrows) through the valve 100 when in such open position], a valve-closed position (FIG. 1B), and a decoupled position (FIG. 1C) where the pump has been brought uphole by a landing/conveying tool 26.

The isolation valve apparatus 100 of the prior art ALII isolation valve apparatus 100 consists of two discrete sub-assemblies, namely the isolation valve 25 sub-assembly and the releasibly coupleable conveying/landing tool sub-assembly 26.

Isolation valve 25 sub-assembly comprises a tubular ported sliding mandrel 160 which is slidably mounted in a seal sub 130. Seal sub 130 is situated below and typically threadably coupled to (directly or indirectly) a downhole side of a pump seating nipple 180, as shown in each of FIGS. 1A, 1B& 1C. Seal sub 170 possesses a port 172 in its sidewall, to allow fluids entry into a bore of sliding mandrel 160 when a first port 140*a* in sliding mandrel 160 is aligned therewith (FIG. 1A). Sliding mandrel 160 at its uphole end has a latch member 150.

Landing tool sub-assembly 26 comprises among other components a ported landing tool 132 having a port 143 therein. Landing tool 132 has at a distal downhole end thereof a releasibly coupling means 133, adapted for releasable coupling to latch member 150 on sliding mandrel 160. At an opposite uphole end of landing tool 132 a pump P and associated uphole piping or tubing 134 are typically releasibly coupled.

Ported landing/conveying tool 132 at its downhole end has a releasible coupling means 133 to permit releasible attachment to latch member 150 to which a pump P and associated uphole piping or tubing 134 may be releasibly coupled.

Landing tool 132, to which pump P and associated uphole piping or tubing 134 are typically releasibly coupled, are together conveyed dowhole within a wellbore to thereby position sliding mandrel 160 within seal sob 130 in the open position as shown in FIG. 1A.

As seen in FIG. 1A, when sliding mandrel 160 within seal sub 130 is slidably positioned in the open position, fluids at the bottom of the wellbore are then permitted to access bore 161 in sliding mandrel 160 via port 172 in seal sub 130 and port 140 in sliding mandrel 160, and be drawn uphole by pump P and caused to exit port 142 in sliding mandrel 160 to enter annular passageway 148 between an outer periphery of the sliding mandrel 160 and the inner periphery of the seal sub 130. Such fluids are thereafter drawn into port 143 and thus into bore 137 of landing tool 132 which is in fluid communication with pump P. Such fluids are then pumped to surface by pump P via production piping/tubing 134 releasibly coupled thereto.

FIG. 1B shows the sliding mandrel 160 having been slidably moved upward when an upward force has been applied to landing tool 132, causing the slidable mandrel to be moved uphole to a closed position within seal sub 130. Further upward movement of the sliding mandrel relative to seal sub 130 has been arrested, and seals 185 within seal sub 130 along an outer peripheral surface of slidable mandrel 130 prevent passage of fluid into bore 161 of sliding mandrel 160 and thus into annular passageway 148, effectively thereafter isolating the underground formation and fluids and gases therein from production piping/tubing 134, unless and until landing tool 132 with pump P and production piping/tubing 134 is again used to move sliding mandrel 160 downhole to thereby allow fluids to again enter ports 172 and 140 and thereafter again be pumped to surface.

FIG. 1C shows the sliding mandrel 160 remaining in the closed position, and the landing tool 132 due to additional upward force applied thereto having been forceably decoupled at the point of releasable coupling to latch member 150 of sliding mandrel 160, and landing tool 132 having thereafter been removed from the wellbore and withdrawn to surface, but nevertheless leaving fluid and gases in the formation within which the wellbore is located effectively isolated from production piping 190 and the wellbore.

Importantly, in the above-described ALII prior art tool design and configuration, since isolation valve sub-assembly 25 is not capable of and cannot independently pass through seating nipple 180, seal sub 130, pump seating nipple 180 and production piping 190, accordingly for such isolation tool to be implemented any existing pump seating nipple 180 and production piping 190 must first be removed from the wellbore. Thereafter, the isolation valve sub-assembly 25 need at surface be threadably inserted onto downhole end of pump seating nipple 180, and the resulting assembly with the production piping then inserted downhole in the wellbore.

Specifically, before the prior art ALII isolation valve can be used, with such prior art ALII isolation tool any existing pump seating nipple 180 and production piping 190 situated in a wellbore must first be removed from the wellbore and the ALII isolation tool assembly at surface be threadably coupled to the most downhole end of the pump seating nipple 180 as shown in FIG. 1A, and thereafter the production piping 190 (with optionally the sliding mandrel 160 threadably inserted within in the seal sub 130) then inserted downhole in the wellbore before the ALII isolation valve 25 of the prior art can be operated by landing tool 132 to open and close isolation valve 25 thereof.

Figure 2A:
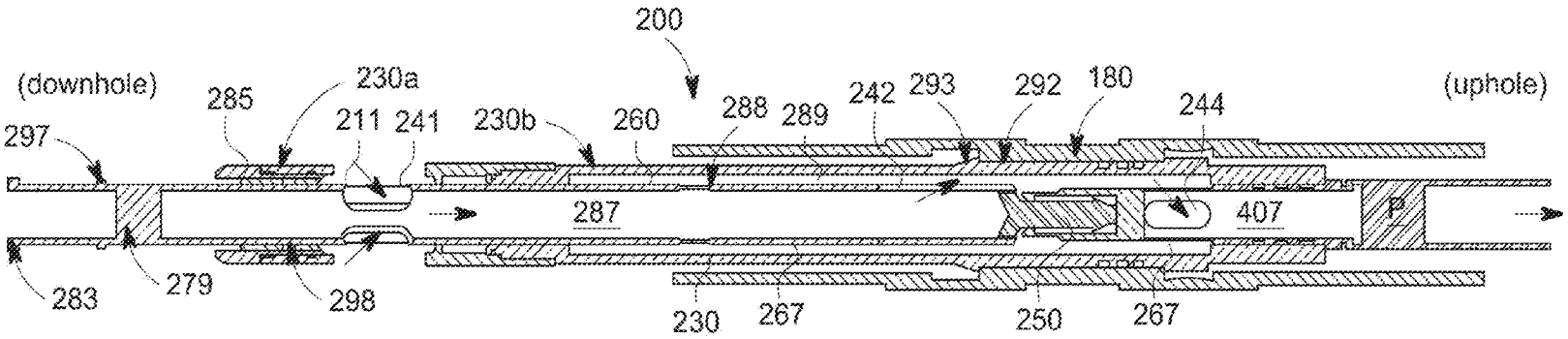
FIG. 2A is a side elevation cross-sectional view of one embodiment of the tubular isolation valve apparatus of the present invention, shown situated within a legacy pump seating nipple, where such tubular isolation valve has been landed to such location by a landing tool to which a production pump is attached, and where such tubular isolation valve is shown in the open position.
Figure 2B:
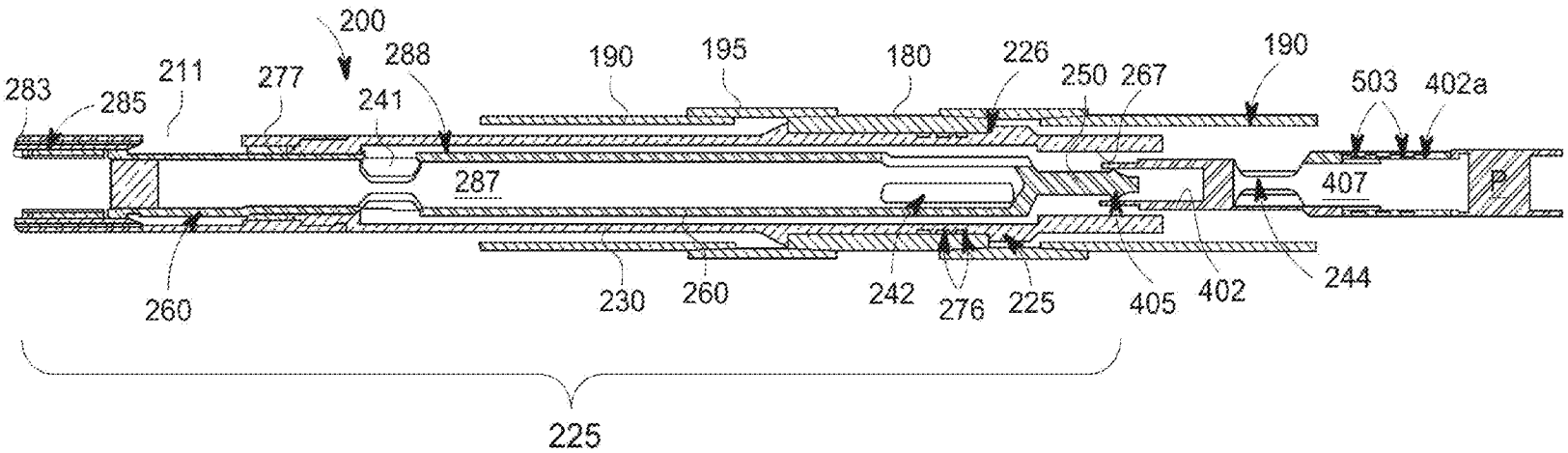
FIG. 2B is a side elevation cross-sectional view of the tubular isolation valve apparatus shown in FIG. 2A, wherein the sliding mandrel has been moved to the closed position by the landing tool to which it is releasibly coupled.

In contrast, FIGS. 2A & 2B and FIGS. 3A & 3B show the isolation valve apparatus 200 of the present invention, with FIGS. 2A &2B showing a first embodiment of the isolation valve apparatus 200, in the open (FIG. 2A) and the closed (FIG. 2B) position.

Figure 3B:
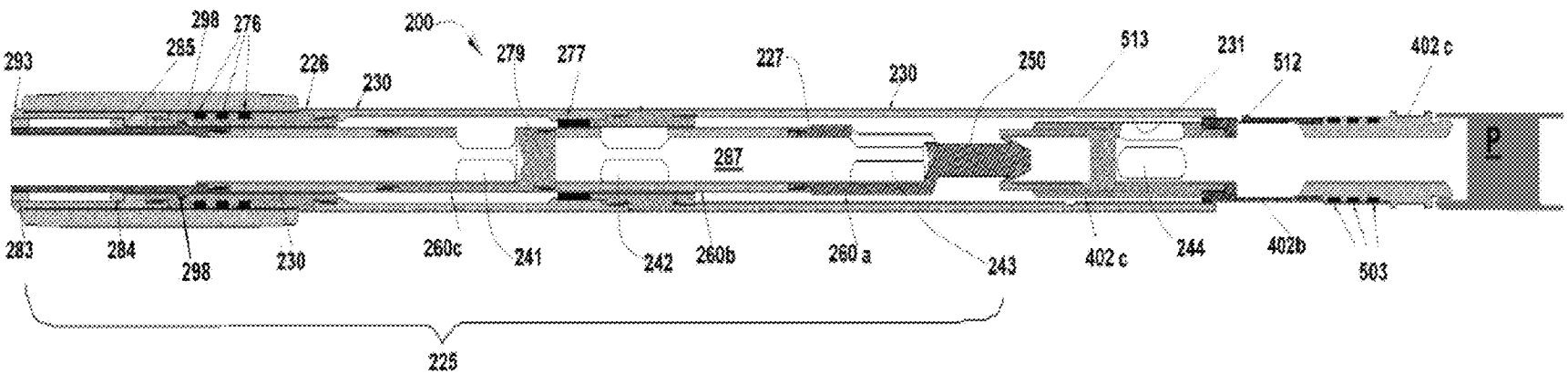
FIG. 3B is a side elevation cross-sectional view of the tubular isolation valve apparatus shown in FIG. 3A, wherein the sliding mandrel has been moved to the closed positon by the landing tool to which it is releasibly coupled.

FIGS. 3A & 3B show a second alternative embodiment of the isolation valve of the present invention, with FIG. 3A showing the additional embodiment in the open position and FIG. 3B showing the additional embodiment in the closed position.

FIGS. 2A & 3A show the isolation valve 225 forming a part of the isolation valve apparatus 200 installed downhole in a wellbore and seated within a pump seating nipple 180 which forms part the production piping 190. A sliding, substantially hollow ported mandrel 260 (slidably moveable within an elongate hollow seal sub 230), having at least two longitudinally spaced-apart ports 241 and 242 therein, is shown in FIGS. 2A &3A slidably positioned in the open position thereby allowing fluids to flow through ports 241, 242, and 243 and uphole in the direction of the depicted arrows.

FIGS. 2B and 3B thereof show the isolation valve 225 of each of the two embodiments, with the sliding ported mandrel 260 of each embodiment shown in the closed position thereby preventing flow of fluids therethrough and subsequently to surface.

Advantageously, the isolation valve apparatus 200 and associated isolation valve 225 of the present invention allows for insertion of isolation valve 225 from uphole into a downhole existing (legacy) production piping 190 without having to first trip out of the existing legacy production piping 190 and pump seating nipple 180 therein, which would otherwise involve considerable time and expense.

Instead, isolation valve apparatus 200 allows not only the isolation valve 225 thereof to be inserted downhole into the existing pump seating nipple 180 and immediately after such isolation valve is landed therein, to thereafter commence production after landing tool 232 has maintained or moved slidable mandrel 260 to the open position.

Such design further allows, when replacement of a pump P is desired, landing tool 402 to reposition sliding mandrel 260 to a closed position and landing tool 402 and associated pump P to be withdrawn from the wellbore for servicing or replacement while nevertheless isolating the formation from the wellbore uphole of the isolation valve 225. Still further, the design allows if ever desired complete removal of seal sub 230 and sliding mandrel 260 from within the wellbore, which capability is further not possible with some earlier designs without having to again trip out all production tubing.

Common to each of the first and second embodiments shown in FIGS. 2A & 2B and FIGS. 3A&3B respectively, isolation valve apparatus 200 in both embodiments comprises a tubing insert isolation valve 225. Tubing insert isolation valve 225 in turn comprises a seal sub 230, shown lowered from surface and landed in a legacy existing pump seating nipple 180, which itself is located towards a downhole end of lengths of interconnected production piping 190.

Seal sub 230 of isolation valve 225 has a slidable portable mandrel 260, positioned within bore 267 of seal sub 230, and such are preferably together in such position lowered in the wellbore and landed within pump seating nipple 180. Sliding mandrel 260 has at least two spaced-apart ports (241, 242) in an outer periphery thererof. Latch member 250 is provided at an uphole end of sliding mandrel 260, and is configured to allow for releasible coupling of sliding mandrel 260 to a landing tool 402. A first (241) of the at least two spaced-apart ports (241, 242) is situated proximate a downhole end of the sliding mandrel 260. A second 242 of said at least two spaced-apart ports (241, 242) is spaced uphole from the first port 241. A stop means 283 is situated on an outer periphery of the siding mandrel 260 at the downhole end thereof.

As noted, seal sub 230 has a bore 267 for slidably receiving therewithin sliding mandrel 260. Sliding mandrel 260 is adapted to be slidably moved within and relative to seal sub 230 from a first (open) position where a portion of the seal sub 230 and the sliding mandrel 260 extend further downhole and past a distal end of the pump seating nipple 180 shown in FIGS. 2A & 3A, to a second more-uphole (closed) position shown in FIGS. 2B & 3B.

Sliding mandrel 260 when slidably positioned in bore 267 of seal sub 230 forms annular fluid passageways 288 in interstitial regions 289 between an outer periphery of sliding mandrel 260 and an inner periphery of the seal sub 230.

Seal sub 230 is further provided with releasable grasping means 292 having outwardly-protruding projections 293 thereon, which in the embodiments shown in FIGS. 2A, 2B, 3A, 3B comprise a collet 292 with the outwardly-protruding projections 293 being the collet fingers of the collet. Such releasable grasping means is adapted to be inserted through pump seating nipple 180 when isolation tool 225 is landed in pump seating nipple 180, and releasibly grasp a downhole distal end of pump seating nipple 180.

An annular no-go portion 226 is provided on a cylindrical periphery of the seal sub 230, allowing a downhole portion of the seal sub 230 including the releasable grasping means 292 to be inserted into and through the pump seating nipple 180 to a position within the pump seating nipple 180 where the outwardly-protruding projections 293 just extend past a downhole end of the pump seating nipple 180. Such serves to thereby positively and with exactitude position the seal sub 230 within pump seating nipple 180.

Two separate seals 276, 277 are provided on seal sub 230. A first seal 276 is located on an outer periphery of hollow seal sub 230 and serves to create a seal between an outer peripheral portion of the seal sub 230 and an inner periphery of the pump seating nipple 180 when the seal sub 230 is inserted in the pump seating nipple 180 and arrested from further insertion therein by the annular no-go portion 226. A second seal 277 is located in bore 267 of hollow seal sub 230 on an inner periphery thereof. Second seal 277 serves to create a seal in the annular passageways 288 between an outer periphery of the sliding mandrel 260 and the inner periphery of the seal sub 230.

When seal sub 230 together with sliding mandrel 260 are together inserted in pump seating nipple 180 further downhole movement of the seal sub 230 in pump seating nipple 180 is prevented by the annular no-go portion 226 of seal sub 230. When seal sub 230 is thereby landed in pump seating nipple 180, the outwardly-protruding projections 293 of releasable grasping means 292 contact pump seating nipple 180 at a most downhole end thereof and thereby resist movement uphole of seal sub 230 relative to pump seating nipple 180 and thus resist removal of seal sub 230 from its landed position within pump seating nipple 180.

Due to first seals 226 on exterior of seal sub 230 frictionally engaging the bore of pump seating nipple 180, landing tool 402 will typically need to forcibly insert seal sub 230 within pump seating nipple 180, which will typically require downward force on sliding mandrel 260, thus causing sliding mandrel 260 when seal sub 230 is landed in seating nipple 180 to be in the open position whereby fluid flow in the annular passageways 288 is thereby automatically then permitted.

Pump P, typically coupled to conveying tool 402, may immediately then be operated to pump fluids passing into isolation valve 225 to surface.

In the first embodiment of isolation valve 225 shown in FIGS. 2A & 2B, when sliding mandrel 260 is in the open position (FIG. 2A), fluids enter seal sub 230*a* via aperture 211 therein and via first port 241 in sliding mandrel 260 enter bore 287 of sliding mandrel 260. Such fluids may then flow or be caused to flow uphole and exit port 242, thereby flowing into annular passageway 288, where they can then further pass uphole and into port 244 of landing tool 402, where such fluids may then pass to pump P for further pumping uphole.

Thereafter, should pump P become worn or be in need of repair or upgrade and thus need be removed from the wellbore, landing tool 402 (still removably coupled to latch member 250 on sliding mandrel 260) may be pulled upward by upward force applied to the latch member 250. Seal sub 230 remains fixed in the pump seating nipple 180 due to the releasable grasping means 292 acting on the pump seating nipple 180 and resisting upward removal of the seal sub 230 from the pump seating nipple 180. At a point, continued upward movement of sliding mandrel in seal sub 230 is arrested by arresting means, which in the embodiment shown in FIGS. 2A & 2B is the outwardly protruding protrusions/stop means 283 on sliding mandrel 260 contacting a stop surface 285 on seal sub 230*a*, and in the embodiment shown in FIGS. 3A & 3B is the annular shear ring 284 contacting stop surface 285 on the seal sub 230. Sliding mandrel 260 is then in the closed position within the seal sub 230, where second seal means 277 then prevents fluid flow through at least one the annular passageways 288 and thus prevents flow of fluid uphole through the isolation valve 225.

In the second embodiment of the tubing isolation insert valve shown in FIGS. 3A & 3B, a third port 243 in the sliding mandrel 260 is provided, spaced uphole from the second spaced-apart port 242 on sliding mandrel 260. Third port 243 permits flow of fluid from within the sliding mandrel 260 to annular passageways 288, but when sliding mandrel 260 is positioned in the second closed position the second seal means 277 thereof prevents fluid flow not only in said annular passageways 288 but also prevents fluid flow into or across said second spaced-apart port 242 and thus prevents further uphole passage of fluid into and through third port 243.

Once sliding mandrel 230 is moved to the closed position, further upward force applied by landing tool 402, due to seal sub 230 being retained within pump seating nipple 180 by collet fingers 293 thereon engaging downhole distal end of pump seating nipple 180, will cause the releasable coupling means 405 of landing tool 402 (which releasable coupling means in the embodiments shown in FIGS. 2A-3B and FIGS. 4 & 12A/12B comprises collet fingers 406) to be decoupled and released from latch member 250, thereby permitting landing tool 402 to be removed from within the wellbore leaving the isolation valve 225 in operative position within pump seating nipple 180.

Both embodiments of the isolation valve 225 may preferably be provided with a no-go member 227 proximate an uphole end thereof, which serves to prevent excess insertion of the sliding mandrel 260 within the pump seating nipple 180 and serves to precisely and consistently vertically locate the isolation tool 225 in pump seating nipple 180.

Both embodiments of the isolation valve 225 may further, as may be seen from FIGS. 2A, 2B. 3A, & 3B, be provided with the feature that sliding mandrel 260, on a outer periphery thereof uphole of the stop means 283, has a plurality of protruding collet fingers 297 which together nestably engage an inner cylindrical annulus 298 on the inner periphery of the seal sub 230 when the sliding mandrel 260 is moved to the second closed position in seal sub 230, to thereby resist relative downhole sliding movement between the seal sub 230 and the sliding mandrel 260 and thereby resist inadvertent sliding movement, due to gravity or otherwise, of said sliding mandrel 260 from the second closed position to the first open position, once the landing tool 402 has been releasibly decoupled from the latch member and such landing tool 402 been withdrawn uphole. This is a safety feature which again ensures no inadvertent or unintended opening of the isolation valve 225 and thus undesired communication with surface if there is no pump Pinterposed between the isolation valve and surface of the wellbore.

Both embodiments of the tubing isolation valve 225, as may be seen resepectiverly from FIGS. 2A, 2B, 3A, & 3B, are preferentially provided with a plug member 279 in a portion of said bore 287 in said sliding mandrel 260 between said second spaced-apart port 242 and said first spaced-apart port 241. When sliding mandrel 260 is in the closed position the second seal means 277 and the plug member 279 together prevent fluid flow in one of said annular passageways 288 between the sliding mandrel 260 and the seal sub 230.

Figure 5:
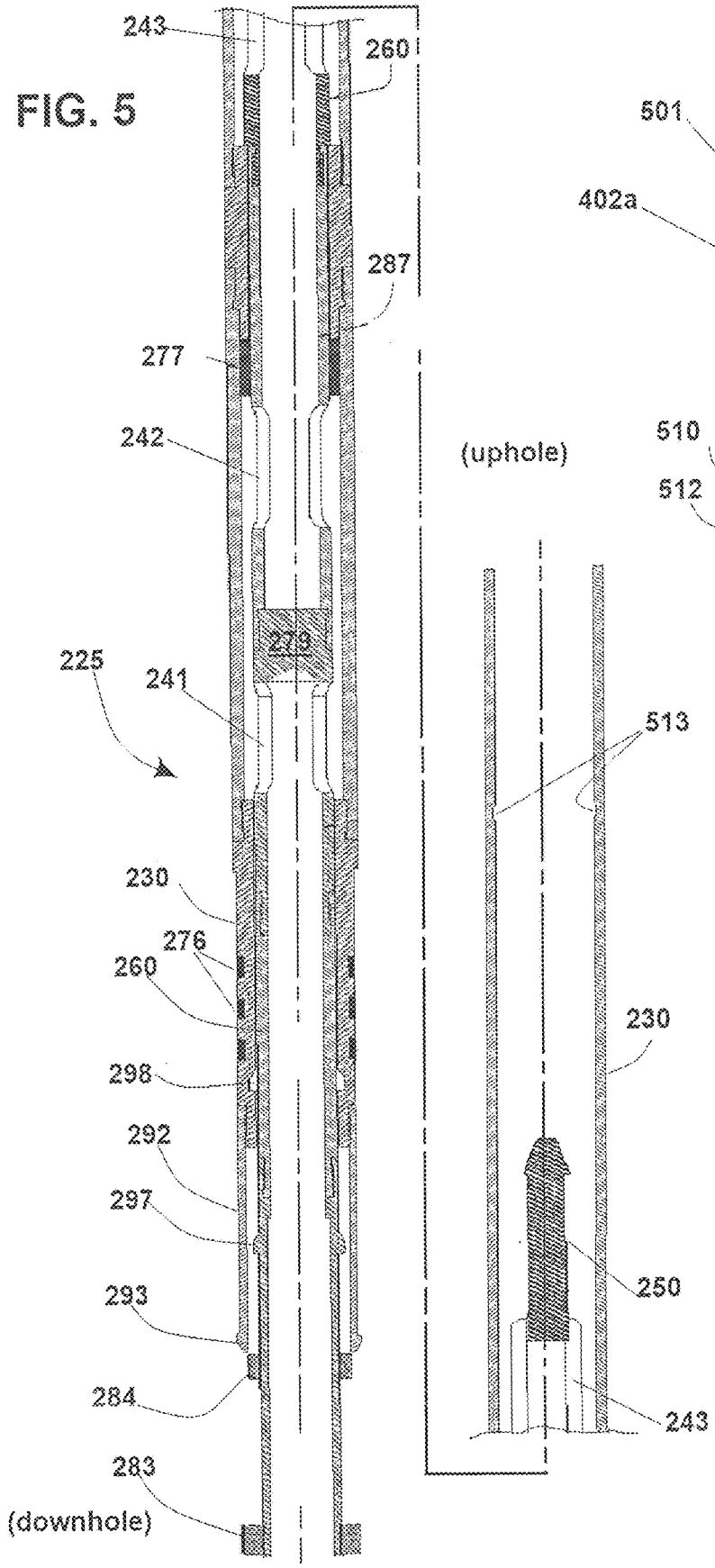
FIG. 5 is a side elevation cross-sectional view of the embodiment of the tubular isolation valve of the present invention shown in FIG. 3A/3B, shown in the orientation and configuration for being run into a wellbore, and in particular when the sliding mandrel thereof is in the open position.
Figure 6:
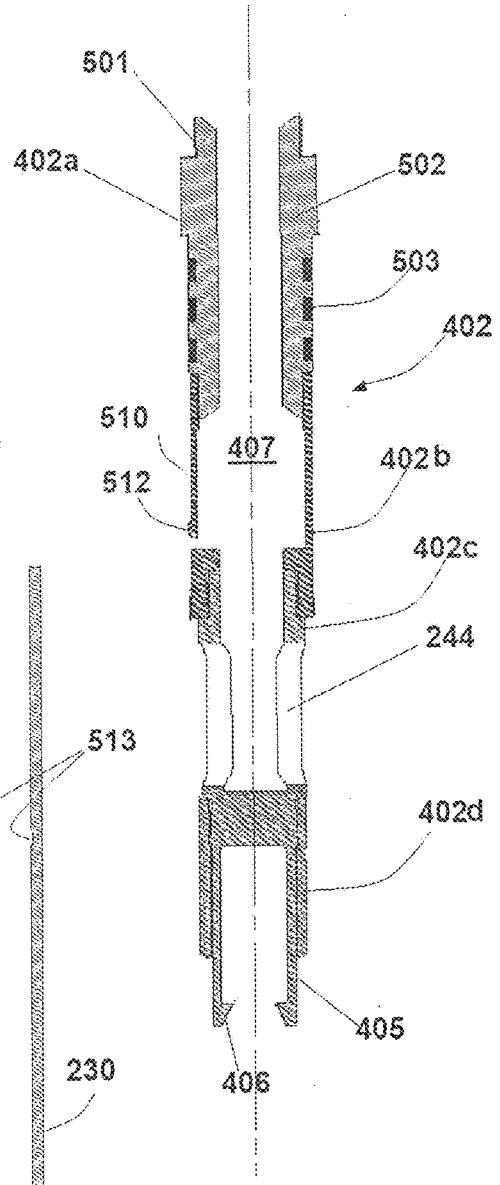
FIG. 6 is a side elevation cross-sectional view of a landing tool for use with either of the tubular isolation valves of the present invention shown respectively in FIGS. 2A, 2B or FIGS. 3A, 3B.
Figure 7A:
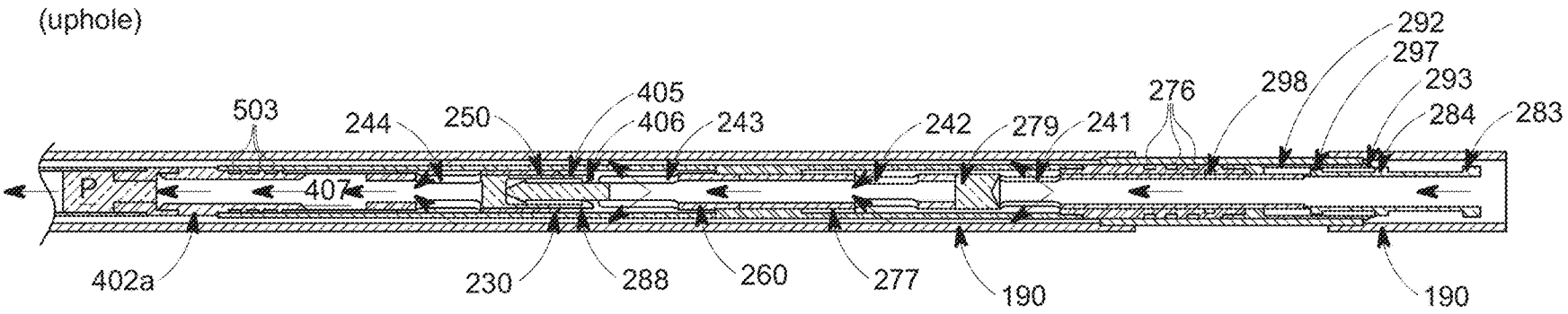
FIG. 7A is a partial side elevation cross sectional view of the tubular isolation valve apparatus of the present invention shown in FIGS. 3A&3B, as oriented and installed in a wellbore, with the isolation valve shown in the open position and showing the flow and direction of fluid flowing though the valve and pump seating nipple.
Figure 7B:
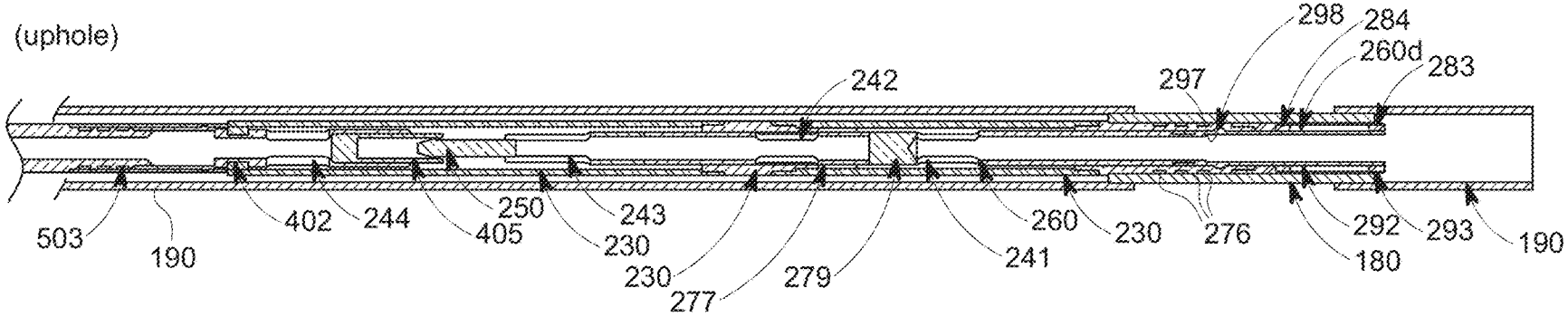
FIG. 7B is a partial side elevation cross sectional view of the tubular isolation valve apparatus of the present invention shown in FIGS. 3A&3B, as oriented and installed in a wellbore, with the sliding mandrel of the valve having been raised by the landing tool to the closed position and consequently showing no fluid flowing though the valve and pump seating nipple.
Figure 7C:
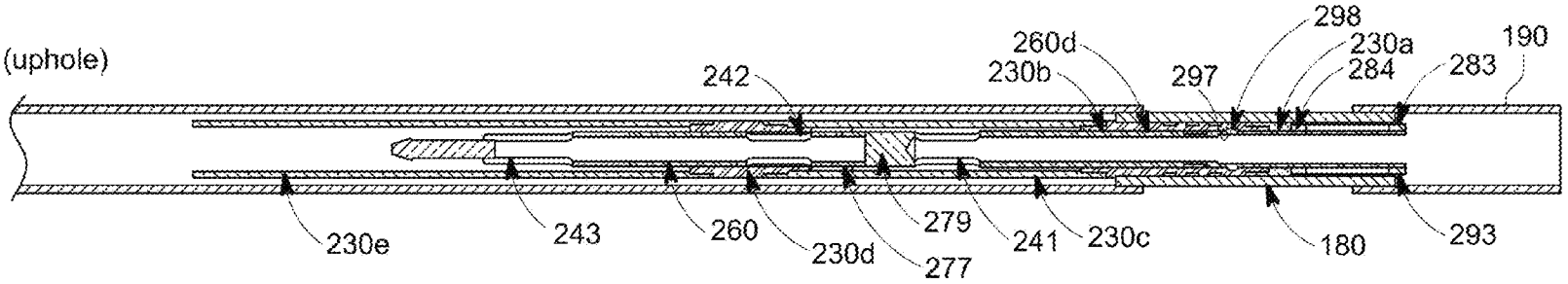
FIG. 7C is a similar view of the tubular isolation valve apparatus of FIG. 7B, after the landing tool and associated pump have together been pulled uphole and thus become decoupled from the sliding mandrel and thereafter removed from the wellbore, where such isolation valve still remains in the closed position.
Figure 7D:
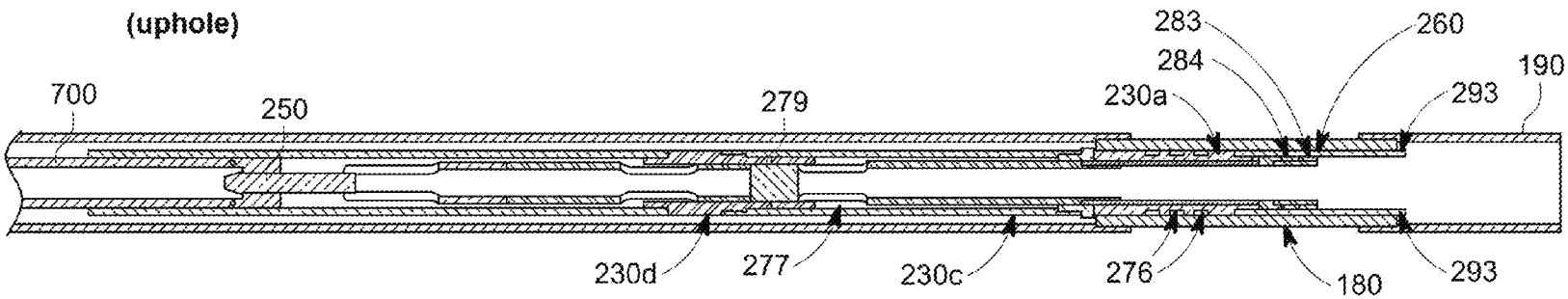
FIG. 7D is a similar view of the tubular isolation valve apparatus of FIG. 7C, showing a fishing tool or retreiveal tool then being inserted down the wellbore and within the seal sub of isolation valve to grasp the seal member (or alternatively the latch member) of isolation valve.
Figure 7E:
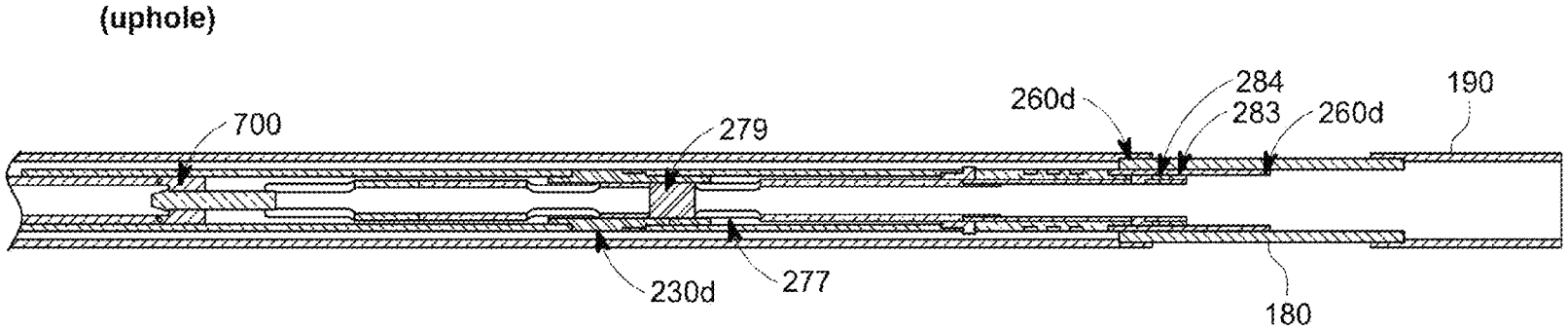
FIG. 7E is a similar view of the tubular isolation valve of FIG. 7D, showing a fishing tool or retrieval tool having caused the isolation valve to be disengaged from the pump seating nipple, and the isolation valve accordingly being pulled uphole from within the pump seating nipple.

Notably, however, and unlike the embodiment shown in FIGS. 2A & 2B, the second embodiment of the isolation valve 225 as shown in FIGS. 3A & 3B, 4-6, 7A-7E, & 8A-8B is provided with an annular shear ring 284. Advantageously, such shear ring 284 in conjunction with the features described below and as shown in FIGS. 3A & 3B, 4-6, 7A-7E, & 8A-8B further allows, if desired, isolation valve 225 to be completely withdrawn from the wellbore via use of a retrieving tool 700 (ref. FIG. 7D-7E) and from within the pump seating nipple 180 and the wellbore, in the manner/method further described herein. (This capability is not possible in the ALII™ tool design.

Specifically, and as may be most clearly seen from FIGS. 3B & 7D-7E, shear means 284 is adapted [if a greater force than what was necessary to pull sliding mandrel 260 and annular shear ring 284 to a position contacting stop surface 285 is thereafter applied to latch member 250] to then shear. Such permits sliding mandrel 260 to be further pulled uphole such that stop means 283 thereon is moved uphole and away from said protruding collet fingers 293 on seal sub 230, thereby permitting outwardly-protruding collet fingers 293 to move out of engagement with pump seating nipple 180. Such then allows the entirety of said tubing isolation valve 225, including sliding mandrel 260 and said seal sub 230, to thereafter be pulled further uphole and completely from within pump seating nipple 180 and to surface, without having to trip out the pump seating nipple 180 and associated production piping 190.

Figure 4:
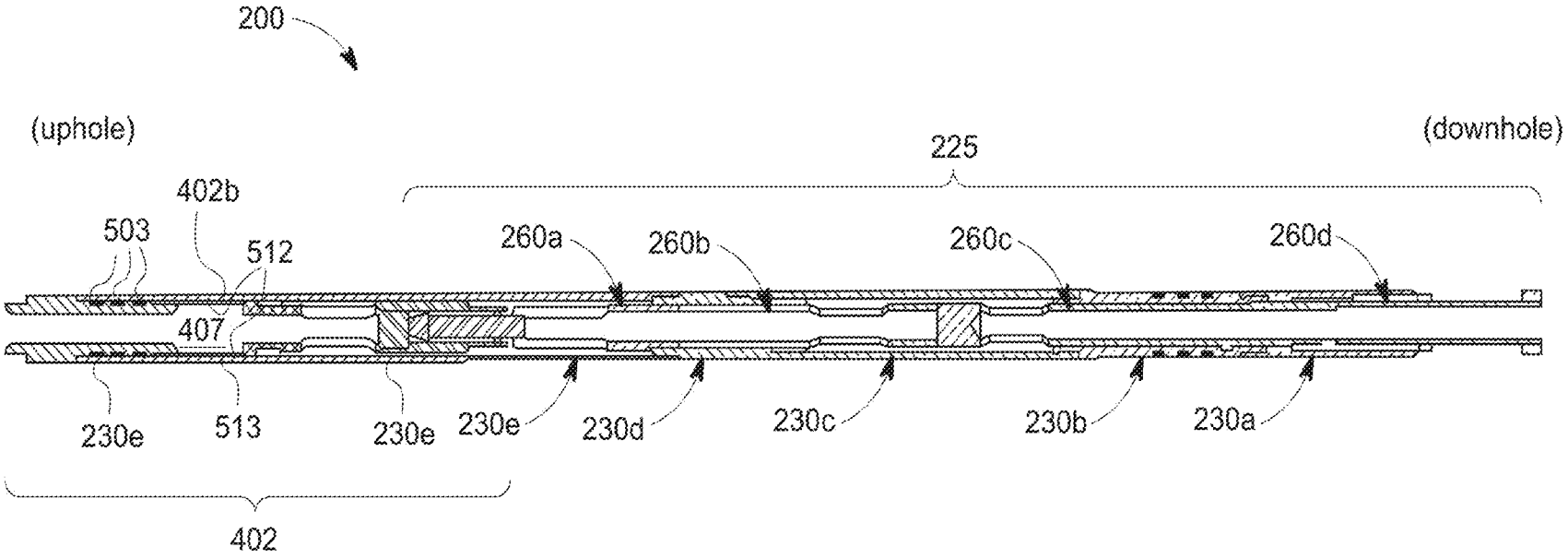
FIG. 4 is a side elevation cross-sectional view of the embodiment of the tubular isolation valve of the present invention shown in FIGS. 3A/3B, shown in the position and orientation in which it is intended to be run into a vertical well via a landing tool of the present design and as disclosed herein.

As may best be seen from FIG. 4 depicting the second embodiment of the isolation valve 225 of the present invention, sliding mandrel 260 may be comprised a plurality of sub-components 260*a*, 260*b*, 260*c*, and 260*d*. Such sub-component composition of the sliding mandrel 260 greatly assists in the ease of manufacture and machining of same and the reduction of machining costs Each of such sub-components 260*a*, 260*b*, 260*c*, and 260*d* may be threadably coupled together in end-to-end relationship., as shown in FIG. 4.

FIG. 9 shows an enlarged detail view of sliding mandrel sub-component 260*c*, showing the (first) access port 241 therein.

FIG. 10 shows an enlarged detail view of sliding mandrel sub-component 260*b*, showing the (second) access port 242 therein.

FIG. 11 shows an enlarged detail view of sliding mandrel sub-component 260*c*, showing the (third) access port 243 therein.

Likewise, as may be seen from the second embodiment of the tubing isolation tool 225 shown in FIGS. 3A & 3B and FIG. 4, seal sub 230 may similarly be comprised of a plurality of separate discrete sub-components, such as for example individual seal sub sub-components 230*a*, 230*b*, 230*c*, 230*d*, & 230*e* in order to thereby assist in the ease of manufacture and machining of same and the reduction of machining costs. Each may be threadably coupled together in end-to-end relationship, as shown in FIG. 4.

FIG. 13 shows an enlarged detail view of seal sub sub-components 230*a* and 230*b*, threadably coupled together. The most-downhole sub-component 230*a* comprises, at its downhole end, and as may be further seen from FIGS. 3A, 3B, 7A-7C, and 8A, 8B, a collet 292 having a plurality of collet fingers which have outwardly-protruding projections 293 thereon, which are adapted, when seal sub 230 is landed in pump seating nipple 180, to releasibly engage a most-downhole end of pump seating nipple 180 as shown in FIGS. 3A, 3B, 7A-7C, and 8A, 8B so as to resist upward removal of seal sub 230 from within pump seating nipple 180, except when removal of the isolation valve 225 from pump seating nipple 180 and the wellbore is desired.

FIG. 14 shows an enlarged detail view of seal sub sub-component 230*c*, which at its downhole end permits threadable coupling to the uphole end of seal sub sub-components 230*a*, 230*b*, shown in FIG. 13.

FIG. 5 is an enlarged side elevation cross-sectional view of the tubular isolation valve 225 of the present invention, namely of the embodiment of the isolation valve 225 shown in FIGS. 3A & 3B, shown in the orientation and configuration for being run into a wellbore, and in particular when the sliding mandrel 230 thereof is in the open position.

Reference numerals set out and depicted in FIG. 5 are the same as for the components described in relation to FIGS. 3A & 3B.

FIG. 6 is an enlarged side elevation cross-sectional view of a landing tool 402 shown in the orientation and configuration for running the isolation valve 225 into a wellbore. Landing tool 402 forms part of the tubing isolation valve apparatus 200 of the present invention and is used for conveying isolation valve 225 downhole and for landing such isolation valve 225 within pump seating nipple 180, and for actuating such isolation valve 225 from an open to a closed position and thereafter being withdrawn from the wellbore along with a pump P coupled thereto when the associated pump P is in need of replacement or repair. Landing tool 402 is adapted for use with either embodiment of the tubular isolation valve 225 of the present invention shown in FIG. 2A, 2B or FIG. 3A, 3B respectively. Landing tool 402 is adapted to be threadably coupled at its threaded uphole end 501 to a pump P.

FIG. 12A shows the ported decoupleable landing tool 402 in side elevation view.

FIG. 12B (and likewise FIG. 6) is a cross-sectional view of ported landing tool 402, which as may be seen, may likewise be comprised for ease of manufacture of a plurality of sub-components 402*a-d*, which may be each threadably connected together, as shown.

At its downhole end, and as seen in FIG. 12B and FIG. 6. landing tool 402 in one embodiment possesses a releasable coupling 405 which may comprise a plurality of collet fingers 406 having inwardly-extending projections thereon which are adapted to releasably grasp latch member 250 of sliding mandrel 260. The landing tool 402 becomes decoupled from latch member 250 on sliding mandrel 260 when upward force applied to landing tool 402 exceeds a designed maximum force, which designed maximum force is less than the upward force necessary to shear shear ring 284 from active engagement with sliding mandrel 260.

At its uphole end, sub-component 402*a* of landing tool 402 possesses threads to allow threadable coupling to a pump P, as shown for example in FIGS. 3A, 3B.

In a preferred but non-necessary embodiment, and as best shown in FIGS. 4 & 6, landing tool 402 may be provided proximate its midsection (ie. in sub-component 402*b* thereof) with a collet having outwardly-protruding projections (collet fingers) 512 thereon, which collet fingers 512 when landing tool 402 is inserted in the uphole proximal end of sliding mandrel 260 as shown in FIG. 4, engage cylindrical annulus 513 in sliding mandrel 260 thereby assisting retaining landing tool 402 and sliding mandrel 260 temporarily coupled together in the position shown in FIGS. 3A & 4 during the landing of isolation valve 225 within pump seating nipple 180 and during the period when the valve is open and pump P is pumping liquids from the wellbore to surface.

Sub-component 402*a* may be provided with a plurality of annular seals 503 on an outer periphery thereof, which when landing tool 402 is inserted in a proximal uphole end of sliding mandrel 260, ensure that pump P when operating is able to successfully "pull" fluids from bore 407 and from annular fluid passageways 288 in interstitial regions 289 between an outer periphery of the sliding mandrel 260 and an inner periphery of the seal sub 230 and thus through isolation valve 225 and thereafter through bore 407 in landing tool 402, and thereafter pump such fluids uphole.

FIGS. 7A-7F show respectively various successive steps in the method, and the configuration of the various components used in the method of the present invention.

FIG. 7A shows the method and configuration of the various components of the tubing isolation valve apparatus 200, in relation to the landing of an isolation valve 225 thereof in pump seating nipple 180, with the isolation valve 225 shown in the open position and showing the flow and direction of fluid flowing though the isolation valve 225 and pump seating nipple 180 during pumping from the wellbore.

FIG. 7B shows a subsequent step in the method, when the pump P is desired to be pulled from the wellbore for servicing and repair, namely the manner of manipulating the isolation tool 225 by pulling it uphole so as to close isolation valve 225, and consequently showing no fluid flowing though the valve 225 and pump seating nipple 180.

FIG. 7C shows a subsequent step of the method and configuration of the various components of the isolation valve 225 when effectively isolating the wellbore and production piping 190 from fluids and gases in a hydrocarbon formation, further showing the landing tool 402 of the tubing isolation valve apparatus 200 having been decoupled from latch member 250 and withdrawn from the wellbore, leaving isolation valve 225 in its operative (isolating) configuration.

FIG. 7D shows a subsequent step in the method and the configuration of the various components of the isolation valve 225 when the isolation valve 225 is subsequently desired to be fully withdrawn from the wellbore, without having to trip out the pump seating nipple and associated production piping 190. A separate retrieving tool 700 has been employed and caused to be coupled to latch member 250. Upward force has been applied by retrieving tool 700 to latch member 250 (and thus sliding mandrel 260), so as to have caused the shear ring 284 to have sheared thus permitting the sliding mandrel 260 and associated stop means 283 to have together moved upwardly in seal sub 230 such that stop means 283 no longer remains under outwardly-protruding projections 293 on seal sub 230, thus permitting outwardly-protruding projections 293 to move inwardly and thereby become decoupled from a most-downhole distal end of pump seating nipple 190, thereby "freeing" seal sub 230 from pump seating nipple 180 and permitting it and sliding ported mandrel 260 to thereafter be drawn uphole.

FIG. 7E shows a subsequent step in the method and the configuration of the various components of the isolation valve 225 when the isolation valve 225 has subsequently been partially withdrawn from pump seating nipple 180.

Figure 7F:
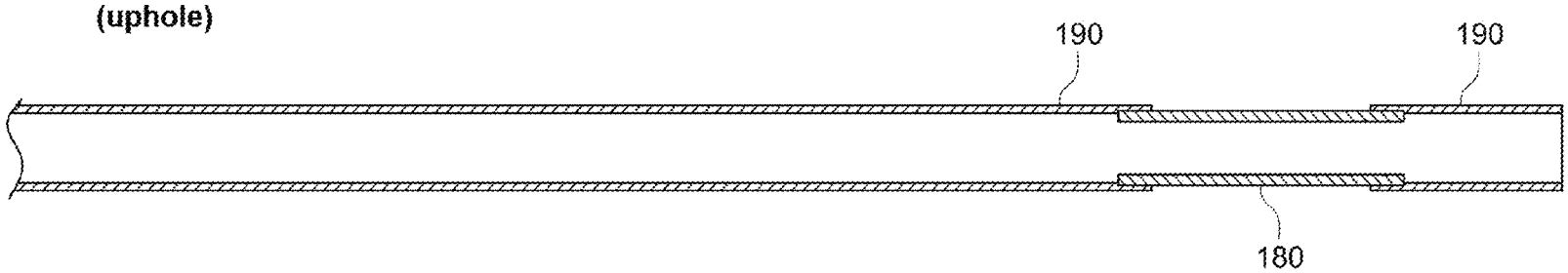
FIG. 7F is a view of the wellbore after the isolation valve has been retrieved and pulled to surface, leaving only the legacy pump seating nipple in the wellbore.

Finally, FIG. 7F shows a subsequent final step in the method when the isolation valve 225 has subsequently withdrawn from the wellbore, leaving the pump seating nipple 180 and associated production piping 190 in the wellbore.

Figure 8A:
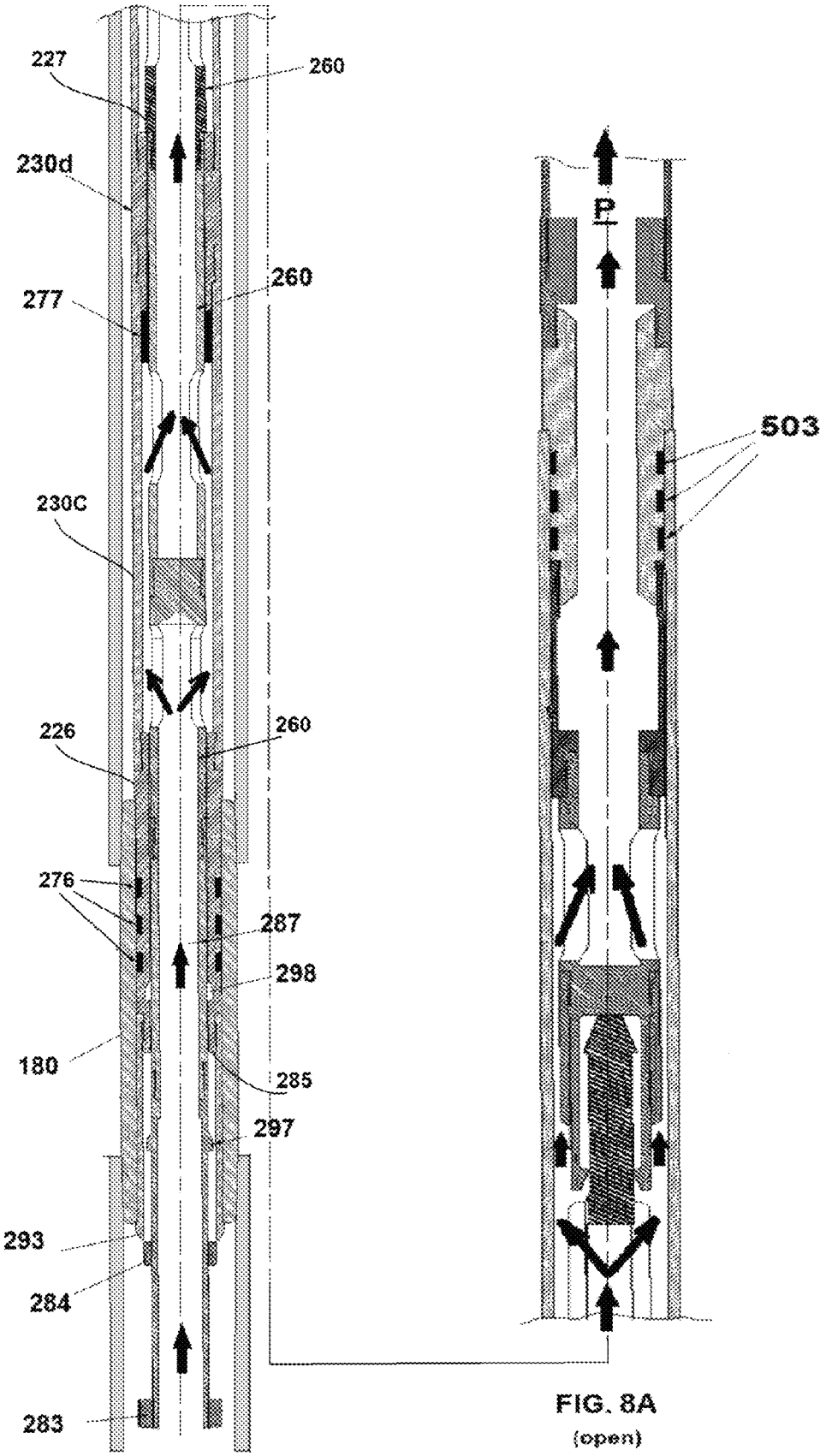
FIG. 8A is an enlarged view of FIG. 3A, with the isolation valve oriented in the wellbore and shown in the open position.

FIG. 8A is an enlarged view of the embodiment of the isolation valve apparatus 200 shown in FIG. 3A with the isolation valve 225 oriented vertically in the wellbore and such isolation valve 225 having been manipulated by landing tool 402 in the open position, with the pump P operating so as to pull downhole fluids through the valve 225 and thereafter pumping such fluids to surface in the direction of the depicted arrows.

Figure 8B:
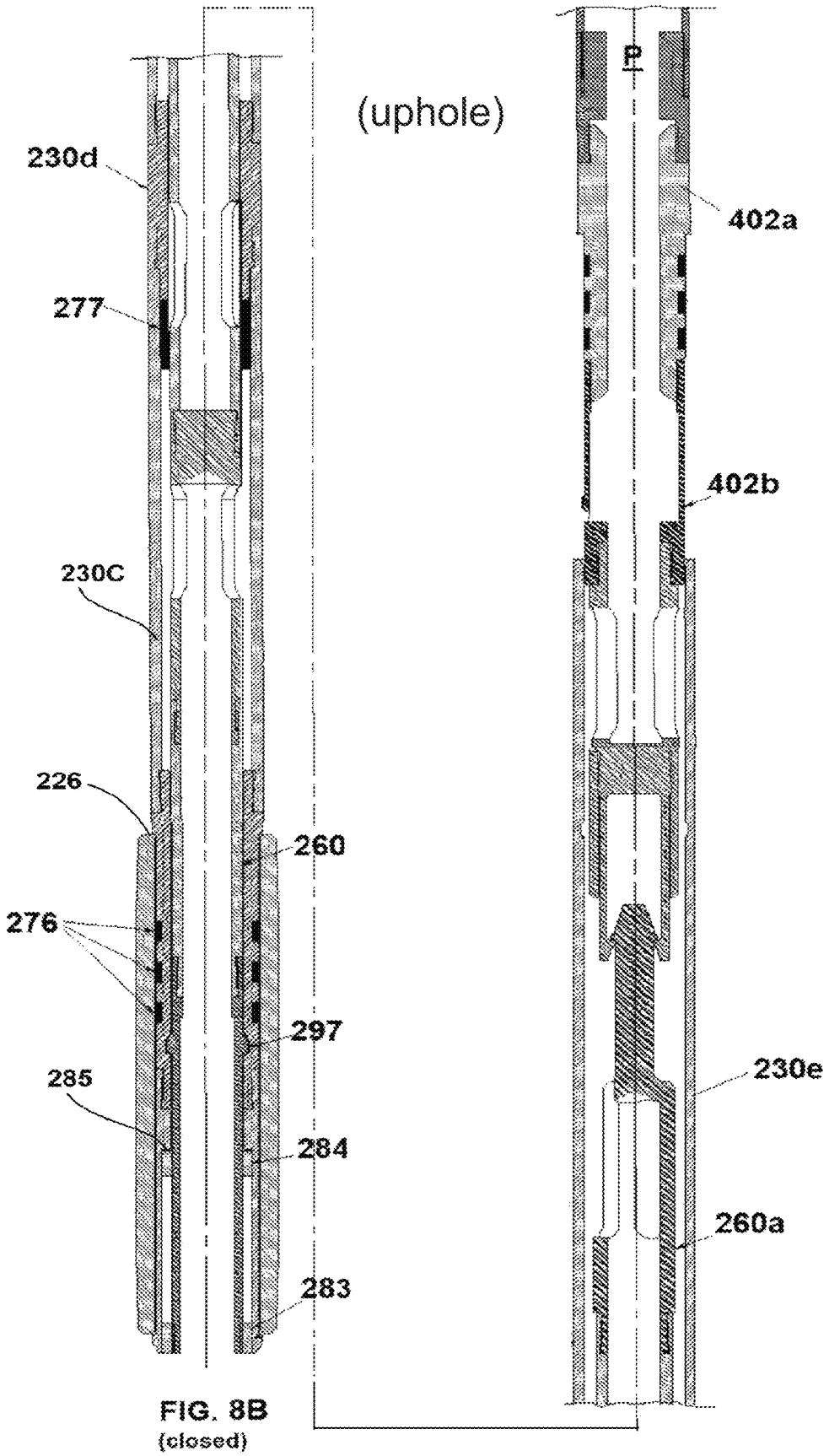
FIG. 8B is an enlarged view of FIG. 3A, with the isolation valve oriented in the wellbore and shown in the closed position.

FIG. 8B is an enlarged view of the embodiment of the isolation valve apparatus 200 shown in FIG. 3B with the isolation valve 225 oriented vertically in the wellbore and such isolation valve 225 having been manipulated by landing tool 402 to the closed position, with the pump P no longer operating nor being able to pull downhole fluids through the valve 225 and thereafter pump such fluids to surface.

Figure 8C:
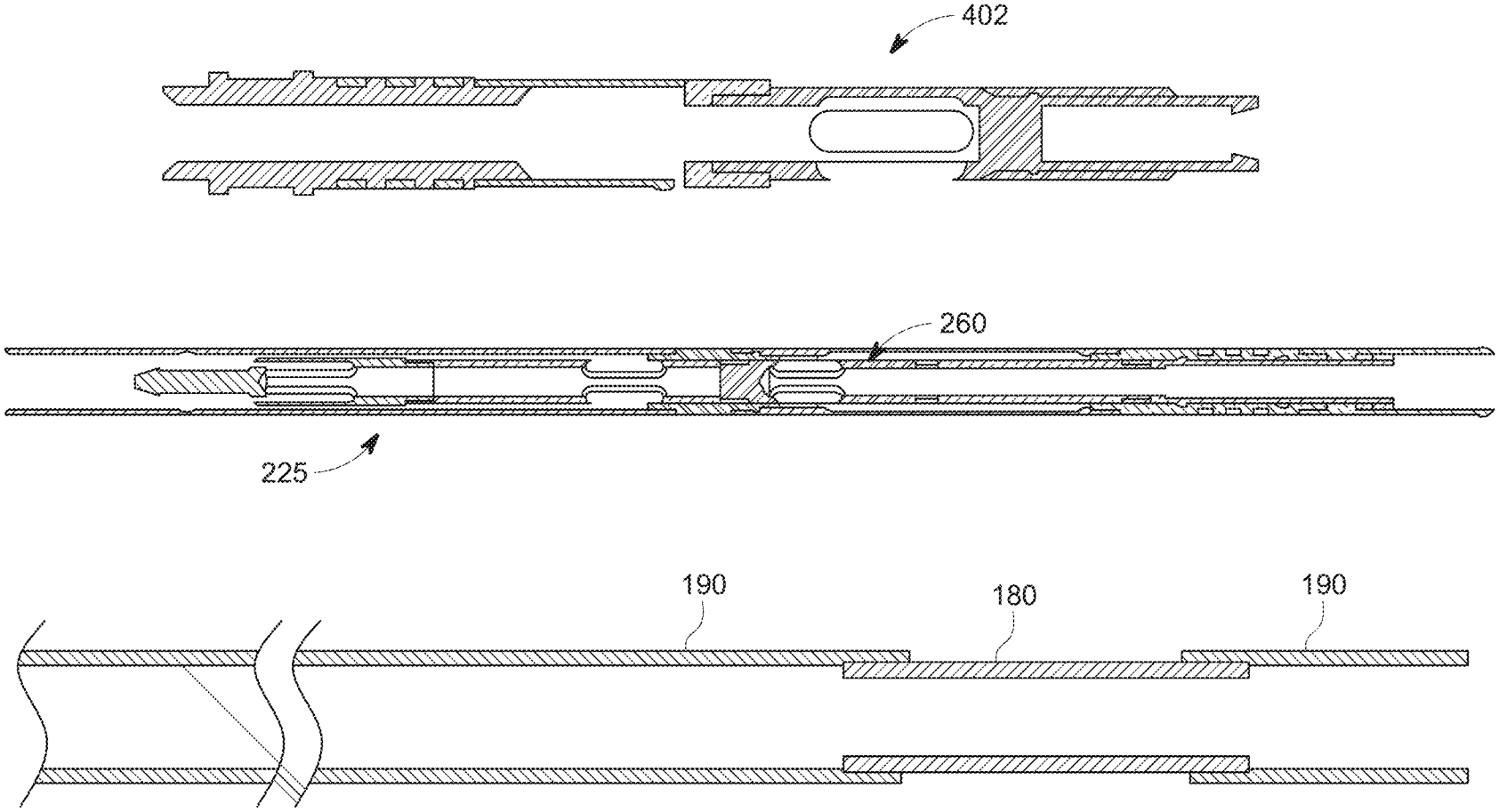

FIG. 8C is a side elevation view showing: (i) the wellbore, similar to FIG. 7F, after the tubing isolation valve apparatus 200 has been removed, (ii) the isolation valve 225 decoupled from the landing tool 402, and (iii) the landing tool 402 when decoupled from isolation valve 225.

For a complete definition of the invention and its intended scope, reference is to be made to the summary of the invention and the appended claims read together with and considered with the disclosure and drawings herein.

I claim:

1. A tubing isolation valve adapted for insertion in a wellbore and configured for insertion in an existing pump seating nipple situated proximate a distal end of a production string located within the wellbore, said isolation valve comprising:

(A) an elongate cylindrical sliding mandrel, having an uphole end and a downhole end, and having at least two axially spaced-apart ports in an outer periphery thereof, said sliding mandrel further having:

(i) a latch member at said uphole end thereof, configured to allow for releasibly coupling of the sliding mandrel to a landing tool;

(ii) a first of said at least two spaced-apart ports situated proximate said downhole end, downhole of the latch member;

(iii) a second of said at least two spaced-apart ports spaced uphole from the first port on the sliding mandrel; and (iv) a stop means, situated on said outer periphery of the siding mandrel proximate said downhole end thereof, (B) an elongate hollow seal sub, a most-downhole portion of which is adapted to be sealingly and slidably inserted, from a position uphole, thereafter into and through a bore of said existing pump seating nipple situated at the distal end of production tubing in the wellbore, the seal sub having a bore therethrough for slidably receiving therewithin the sliding mandrel and allowing slidable movement of the sliding mandrel from a first downhole open position to a second further-uphole closed position;

the seal sub, when said sliding mandrel is slidably positioned in said bore of said seal sub, forming annular fluid passageways in interstitial regions between said outer periphery of the sliding mandrel and an inner periphery of the seal sub;

the seal sub further comprising:

(i) a releasable grasping means having outwardly-protruding projections thereon;

(ii) an annular no-go portion on an outer periphery of the seal sub, positioned along said seal sub so as to allow a portion of the seal sub including said releasable grasping means and said outwardly-protruding projections thereon to be inserted into and through the pump seating nipple to a position where the outwardly-protruding projections are adapted to then contact a most downhole end of the pump seating nipple;

(iii) two seal means, comprising:

(I) a first seal means located on said outer periphery of said hollow seal sub and adapted to create a seal between a portion of said outer periphery of the seal sub and an inner periphery of the pump seating nipple when the seal sub is inserted in the pump seating nipple; and (II) a second seal means, located in the bore of the hollow seal sub on said inner periphery thereof, adapted to create a seal in the annular passageways between said outer periphery of the sliding mandrel and the inner periphery of the seal sub;

wherein:

(i) when the seal sub together with the sliding mandrel is thereafter inserted from uphole into and through the pump seating nipple, further downhole movement of the seal sub in the pump seating nipple is prevented by the annular no-go portion on said seal sub, and said releasable grasping means and said outwardly-protruding projections thereon are adapted to then contacts said pump seating nipple at the most downhole end thereof and thereby resists removal uphole of said seal sub from within said pump seating nipple and the sliding mandrel and seal sub are thus in the open position whereby fluid flow in the annular passageways is thereby permitted; and (ii) when the sliding mandrel is pulled upward by upward force applied to the latch member the seal sub remains fixed in the pump seating nipple due to the releasable grasping means acting on the pump seating nipple and resisting upward removal of the seal sub from the pump seating nipple, and further upward movement of sliding mandrel in seal sub 230 is arrested by arresting means and the sliding mandrel is then in the closed position within the seal sub and the second seal means then prevents fluid flow through at least one the annular passageways and thus prevents flow of fluid uphole through the pump seating nipple.

2. The tubing isolation valve as claimed in claim 1, wherein said stop means, further comprises said arresting means, and said stop means; prevents further upward movement of said sliding mandrel relative to said seal sub by the stop means contacting a stop surface on the seal sub.

3. The tubing isolation valve as claimed in claim 1, wherein such arresting means comprises shear means situated on the outer periphery of said sliding mandrel proximate said downhole end thereof but uphole of said stop means, and when said further upward movement is arrested by said shear means contacting a stop surface on the seal sub, said stop means moves under said outwardly-protruding projections thereby ensuring said outwardly-protruding projections of said releasable grasping means continue to grasp and remain in engaging contact with the most downhole end of the pump seating nipple thereby resisting removal uphole of said seal sub from within said pump seating nipple.

4. The tubing isolation valve as claimed in claim 3, wherein said shear means, upon further increased uphole force being applied to said sliding mandrel after having contacted said stop surface, causes said shear means to shear allowing further uphole movement of said sliding mandrel relative to said seal sub, and said stop means 283 on said seal sub is thus caused to be moved from under said outwardly-protruding projections, thereby permitting said outwardly-protruding projections to become released from grasping engagement with said pump seating nipple thereby allowing said seal sub and sliding mandrel to thereafter be together completely pulled from within said pump seating and further pulled uphole in the wellbore to surface leaving said pump seating nipple and associated production tubing in the wellbore.

5. The tubing isolation valve as claimed in claim 1, wherein said second seal means when said sliding mandrel is moved to the closed position prevents flow of fluid into said annular passageways and thus uphole in said isolation valve.

6. The tubing isolation valve as claimed in claim 1, wherein said seal sub at a lower extremity thereof possesses an aperture therein, which when said sliding mandrel is in the open position, allows flow of fluid into said first port and thus into a bore of said sliding mandrel.

7. The tubing isolation valve as claimed in claim 1, further comprising:

a third port in the sliding mandrel, spaced uphole from the second spaced-apart port on the sliding mandrel, said third port adapted to permit flow of fluid from within the sliding mandrel into at least one of the annular passageways.

8. The tubing isolation valve as claimed in claim 7 wherein the sliding mandrel is configured such that when positioned in said second closed position said second seal means thereof prevents fluid flow not only into said at least one annular passageway but also prevents fluid flow into or across said second spaced-apart port and thus prevents further uphole passage of fluid.

9. The tubing isolation valve as claimed in claim 1 wherein said releasable grasping means comprises a collet member, and said outwardly-protruding projections comprise outwardly-protruding collet fingers thereon.

10. The tubing isolation valve as claimed in any one of preceding claims 1-9 wherein said siding mandrel further possesses:

(v) a no-go member proximate the uphole end of said sliding mandrel, which serves to prevent excess insertion of the sliding mandrel within the pump seating nipple.

11. The tubing isolation valve as claimed in claim 1, said sliding mandrel further having a plug member in a portion of said bore in said sliding mandrel between said second spaced-apart port and said first spaced-apart port therein, and when said sliding mandrel is in said closed position said second seal means and said plug member together prevent fluid flow into a portion of said bore of said sliding mandrel.

12. The tubing isolation valve as claimed in claim 1, wherein said sliding mandrel, on said outer periphery thereof uphole of said stop means has a plurality of protruding collet fingers which together nestably engage an inner cylindrical annulus on said inner periphery of said seal sub when said sliding mandrel is moved to said second closed position in said seal sub, to thereby resist relative downhole sliding movement between said seal sub and said sliding mandrel and thereby resist inadvertent sliding movement of said sliding mandrel from said second closed position to said first open position.

13. The tubing isolation valve as claimed in claim 3, wherein the shear means is adapted, if a greater force than what was necessary to pull the sliding mandrel to said second position is applied to the latch member, to shear, thereby permitting the sliding mandrel to be further pulled uphole such that the stop means thereon is moved uphole and away from said protruding collet fingers on said seal sub, then permitting said outwardly-protruding collet fingers to move inward and out of engagement with said pump seating nipple, thereby allowing the entirety of said tubing isolation valve, including said sliding mandrel and said seal sub, to be pulled uphole and to surface.

14. A tubing isolation valve apparatus comprising the tubular isolation valve as claimed in claim 1, further comprising:

a decoupleable landing tool, having an uphole end and a downhole end, which downhole end is insertable into said bore of said seal sub, the decoupleable landing tool further comprising:

(i) at said downhole end, releasable coupling means for releasably coupling said landing tool to said latch means of said slidable mandrel; and (ii) a port situated in said landing tool at a location thereon uphole of said coupling means, adapted to allow fluid from said annular passageways of said isolation valve to flow into a bore of said decoupleable landing tool.

15. The tubing isolation valve apparatus as claimed in claim 14, wherein said decoupleable landing tool, at said uphole end thereof, is adapted to be releasably coupleable to a pump.

16. The tubing isolation valve apparatus as claimed in claim 14, wherein when a pump is coupled to said uphole end of said landing tool and said pump is in fluid communication with said bore of said decoupleable landing tool, and when said decoupleable landing tool is releasibly coupled to said latch member and the sliding mandrel positioned in the open position, the pump is adapted to pump fluid from the bore of the decoupleable landing tool and thereafter uphole.

17. A method of utilizing a tubing isolation valve in an existing pump seating nipple situated at a distal end of a production string located within a wellbore, for permitting pumping of fluid from the wellbore but nevertheless maintaining the ability to thereafter if desired withdraw a pump from the wellbore without losing wellbore containment, and if further desired fully withdraw the entire tubular isolation valve including the pump from the wellbore without having to trip out the pump seating nipple and production piping, comprising the steps of:

(i) slidably positioning an elongate cylindrical ported mandrel having at least two spaced-apart ports therein within and through a bore of a hollow seal sub until further downhole sliding movement of said ported mandrel within and relative to the seal sub is prevented by a no-go member and the ported mandrel in the seal sub is in an open position where fluid may flow through all at least two spaced-apart ports;

(ii) coupling said pump P to an uphole end of a landing tool so that the pump is in fluid communication with a hollow bore of the landing tool;

iii) releasibly coupling the landing tool, at a downhole end thereof, to a latch member at an uphole end of the ported mandrel;

(iv) frictionally engaging the landing tool with, or releasibly coupling the landing tool to, an interior periphery of the seal sub at an uphole end of said seal sub;

(v) lowering the seal sub and ported mandrel downhole in the wellbore using the landing tool to a location within the wellbore wherein at least a portion of the seal sub and ported mandrel pass into and through the pump seating nipple;

(vi) arresting complete passage of both the ported mandrel and seal sub through the pump seating nipple 180 by lowering the seal sub and ported mandrel using said landing tool to a position where an annular no-go portion on an exterior periphery of the seal sub contacts the pump seating nipple, thereby arresting further downhole movement of the seal sub and ported mandrel into the pump seating nipple; and (vii) when in said arrested position causing collet fingers on the seal sub to engage the pump seating nipple so as to thereafter resist uphole movement of the seal sub from within the pump seating nipple.

18. The method of utilizing a tubing isolation valve as claimed in claim 17, comprising the further subsequent steps of:

(i) when desiring to remove the pump from within the wellbore, pulling uphole on the landing tool and causing the ported mandrel to slide within the seal sub to a position within the seal sub where further uphole motion of the sliding mandrel is arrested by a shear means on the sliding mandrel contacting a stop surface on the seal sub, and when the sliding mandrel is in such position fluid is prevented from passing through the seal sub and/or the ported mandrel;

(ii) continuing to pull upward on the landing tool so as to cause the releasible decoupling of the landing tool with the latch member on the ported mandrel; and (iii) withdrawing the landing tool and the pump thereon from within the wellbore.

19. The method of utilizing a tubing isolation valve as claimed in claim 18, further comprising the successive additional steps, when then desiring to recommence pumping of fluid from the wellbore, of subsequently:

(i) lowering the landing tool coupled to said pump P at the uphole end thereof downhole in the wellbore;

(ii) coupling the landing tool at the downhole end thereof to the latch member on the ported mandrel;

iii) continuing to lower the landing tool in the wellbore so as to cause the landing tool to slidably move the ported mandrel downhole and relative to the seal sub to a position where further downhole sliding movement of the ported mandrel within and relative to said seal sub is prevented by said no-go portion on the seal sub contacting the pump seating nipple, and when in such position the ported mandrel in the seal sub is in the open position where fluid may flow through all two spaced-apart ports therein; and (iv) thereafter operating the pump to pump fluids through the seal sub and ported mandrel to surface.

20. The method of utilizing a tubing isolation valve as claimed in claim 18 when desiring to remove the entirety of the tubing isolation valve from within the wellbore, comprising the further subsequent steps of:

(i) lowering a retrieving tool to grasp the latch member of the ported mandrel;

(ii) pulling upward on the latch member and ported mandrel using the retrieving tool so as to cause the shear means to shear and the ported mandrel to further move uphole relative to the seal sub until a stop means on the ported mandrel moves from a position supporting the releasable grasping means to a position not supporting the releasable grasping means and instead contacting the seal sub at a stop surface; and (iii) continuing to pull upwardly on the ported mandrel so as to cause releasable grasping means to become disengaged with the pump seating nipple; and (iv) pulling the seal sub and ported mandrel from within the pump seating nipple uphole and from within the wellbore.

* * * * *